US012460150B1

(12) United States Patent
Parker et al.

(10) Patent No.: US 12,460,150 B1
(45) Date of Patent: Nov. 4, 2025

(54) LOW-ASH LUBRICATING COMPOSITIONS

(71) Applicant: AFTON CHEMICAL CORPORATION, Richmond, VA (US)

(72) Inventors: Mariah Parker, Richmond, VA (US); Kenneth Garelick, Mechanicsville, VA (US)

(73) Assignee: AFTON CHEMICAL CORPORATION

( * ) Notice: Subject to any disclaimer, the term of this patent is extended or adjusted under 35 U.S.C. 154(b) by 0 days.

(21) Appl. No.: 18/899,803

(22) Filed: Sep. 27, 2024

(51) Int. Cl.

| | |
|---|---|
| ***C10M 169/04*** | (2006.01) |
| ***C10M 141/10*** | (2006.01) |
| ***C10N 20/04*** | (2006.01) |
| ***C10N 30/00*** | (2006.01) |
| ***C10N 30/04*** | (2006.01) |
| ***C10N 30/06*** | (2006.01) |
| ***C10N 30/12*** | (2006.01) |
| ***C10N 40/25*** | (2006.01) |

(52) U.S. Cl.
CPC ..... *C10M 169/04* (2013.01); *C10M 141/10* (2013.01); *C10M 2219/046* (2013.01); *C10M 2223/045* (2013.01); *C10M 2223/047* (2013.01); *C10N 2020/04* (2013.01); *C10N 2030/04* (2013.01); *C10N 2030/06* (2013.01); *C10N 2030/12* (2013.01); *C10N 2030/24* (2020.05); *C10N 2030/45* (2020.05); *C10N 2030/52* (2020.05); *C10N 2040/25* (2013.01)

(58) Field of Classification Search
CPC ..... C10M 141/10; C10M 169/04; C10M 2219/046; C10M 2223/045; C10M 2223/047; C10N 2020/04; C10N 2030/04; C10N 2030/06; C10N 2030/12; C10N 2030/24; C10N 2030/45; C10N 2030/52; C10N 2040/25
See application file for complete search history.

(56) References Cited

U.S. PATENT DOCUMENTS

| | | | |
|---|---|---|---|
| 2,237,625 | A | 4/1941 | Olin |
| 2,237,627 | A | 4/1941 | Olin |
| 2,527,948 | A | 10/1950 | Lyon, Jr. et al. |
| 2,695,316 | A | 11/1954 | Mcbride |
| 2,995,569 | A | 8/1961 | Hamilton et al. |
| 3,022,351 | A | 2/1962 | Mihm et al. |

(Continued)

FOREIGN PATENT DOCUMENTS

| | | | |
|---|---|---|---|
| CA | 3212981 | A1 | 10/2022 |
| CN | 112760155 | B | 9/2022 |

(Continued)

OTHER PUBLICATIONS

Haenel et al., Systematic Approach to Analyze and Characterize Pre-ignition Events in Turbocharged Direct-injected Gasoline Engines, SAE Int., Apr. 2011.

(Continued)

*Primary Examiner* — James C Goloboy
(74) *Attorney, Agent, or Firm* — Honigman LLP

(57) ABSTRACT

This disclosure describes low-ash lubricating composition achieving the same or better performance of higher ash compositions by including selected antiwear system with ashless phosphorus-containing antiwear compounds and select detergent systems matching TBN contributions to the antiwear systems.

17 Claims, 1 Drawing Sheet

(56) References Cited

U.S. PATENT DOCUMENTS 3,219,666 A 11/1965 Norman et al.
3,308,166 A 3/1967 Biensan et al.
3,350,348 A * 10/1967 Braid et al. ..... C10M 137/105 558/160
3,392,201 A 7/1968 Warner
3,471,404 A 10/1969 Myers
3,502,677 A 3/1970 Le Suer
3,565,804 A 2/1971 Honnen et al.
3,634,515 A 1/1972 Piasek et al.
3,673,090 A 6/1972 Waldbillig et al.
3,697,429 A 10/1972 Engel et al.
3,697,574 A 10/1972 Piasek et al.
3,703,504 A 11/1972 Horodysky
3,703,505 A 11/1972 Horodysky et al.
3,736,357 A 5/1973 Piasek et al.
3,763,244 A 10/1973 Shubkin
3,796,661 A 3/1974 Suratwala
3,816,346 A 6/1974 Coppock et al.
3,873,454 A 3/1975 Horodysky et al.
3,991,056 A 11/1976 Okamoto et al.
4,036,771 A 7/1977 Denis et al.
4,118,329 A 10/1978 Hotten
4,119,549 A 10/1978 Davis
4,119,550 A 10/1978 Davis et al.
4,147,640 A 4/1979 Jayne et al.
4,191,659 A 3/1980 Davis
4,204,969 A 5/1980 Papay et al.
4,218,332 A 8/1980 Schwab
4,234,435 A 11/1980 Meinhardt et al.
4,240,958 A 12/1980 Braid
4,282,392 A 8/1981 Cupples et al.
4,285,822 A 8/1981 deVries et al.
4,344,854 A 8/1982 Davis et al.
4,472,306 A 9/1984 Powers et al.
4,537,696 A 8/1985 Beimesch
4,564,709 A 1/1986 Koyama et al.
4,587,368 A 5/1986 Pratt
4,636,322 A 1/1987 Nalesnik
4,711,736 A 12/1987 Horodysky et al.
4,747,971 A 5/1988 Erdman
4,795,576 A 1/1989 Born et al.
4,857,214 A 8/1989 Papay et al.
4,925,983 A 5/1990 Steckel
4,941,984 A 7/1990 Chamberlin, III et al.
4,954,274 A 9/1990 Zaweski et al.
4,956,122 A 9/1990 Watts et al.
4,966,720 A 10/1990 DeGonia et al.
4,992,183 A 2/1991 Beimesch et al.
5,089,156 A 2/1992 Chrisope et al.
5,114,602 A 5/1992 Petrille et al.
5,266,223 A 11/1993 Song et al.
5,439,605 A 8/1995 Khorramian
5,614,480 A 3/1997 Salomon et al.
5,627,259 A 5/1997 Thaler et al.
5,633,326 A 5/1997 Patil et al.
5,643,859 A 7/1997 Gutierrez et al.
5,792,729 A 8/1998 Harrison et al.
5,851,965 A 12/1998 Harrison et al.
5,853,434 A 12/1998 Harrison et al.
5,936,041 A 8/1999 Diana et al.
6,117,825 A 9/2000 Liu
6,124,247 A 9/2000 Cazin et al.
6,303,546 B1 10/2001 Hata et al.
8,163,681 B2 4/2012 Bardasz et al.
8,260,530 B2 9/2012 Rollinger et al.
8,327,687 B2 12/2012 Amann et al.
8,404,624 B2 3/2013 Ribeaud
8,543,315 B2 9/2013 Glugla et al.
8,598,097 B2 12/2013 Artman et al.
8,709,984 B2 4/2014 Bhalla et al.
9,481,696 B1 11/2016 Edwards et al.
9,528,067 B2 12/2016 Mullay et al.
10,000,721 B2 6/2018 Schilowitz et al.
10,005,979 B2 6/2018 Saccomando et al.
10,087,390 B2 10/2018 Esche et al.
10,119,090 B2 11/2018 Gao et al.
10,421,923 B2 9/2019 Saccomando et al.
10,519,396 B2 12/2019 Patterson et al.
10,611,981 B2 4/2020 Abraham et al.
10,704,007 B2 7/2020 Hoey et al.
10,704,009 B2 7/2020 Miller et al.
10,738,263 B2 8/2020 Sutton et al.
10,793,802 B2 10/2020 Abraham et al.
10,913,915 B2 2/2021 Mosier et al.
10,913,916 B2 2/2021 De Rooy et al.
10,982,169 B2 4/2021 Broutin et al.
10,988,702 B2 4/2021 Delbridge et al.
11,008,529 B2 5/2021 Jakupca et al.
11,034,912 B2 6/2021 Ritchie et al.
11,066,621 B2 7/2021 Shimizu et al.
11,142,695 B2 10/2021 Lee et al.
11,155,765 B2 10/2021 Abraham et al.
11,168,278 B2 11/2021 Barton et al.
11,180,710 B2 11/2021 Filippini et al.
11,214,750 B2 1/2022 Milner et al.
11,214,755 B2 1/2022 Susukida et al.
11,345,872 B2 5/2022 Gao
11,365,367 B2 6/2022 Vincent et al.
11,384,308 B2 7/2022 Barton et al.
11,535,808 B2 12/2022 Tamura
11,702,610 B2 7/2023 Knapton et al.
11,739,280 B2 8/2023 Oda et al.
11,739,283 B2 8/2023 Shimizu et al.
11,820,958 B2 11/2023 Champagne et al.
12,060,537 B2 8/2024 Hanthorn et al.
12,098,343 B2 9/2024 Oda et al.
12,270,005 B2 4/2025 Nelson et al.
2002/0165102 A1 11/2002 Hata et al.
2004/0242434 A1 12/2004 Yagishita et al.
2005/0101496 A1 5/2005 Loper et al.
2006/0058200 A1 3/2006 Shaw et al.
2006/0217271 A1 9/2006 Brown et al.
2007/0111904 A1 5/2007 Van Dam
2007/0184992 A1 8/2007 Takeuchi et al.
2008/0128184 A1 6/2008 Loper et al.
2009/0156446 A1 6/2009 McAtee et al.
2011/0111997 A1 5/2011 Cook et al.
2011/0213538 A1 9/2011 Amann et al.
2011/0265761 A1 11/2011 Amann et al.
2012/0029789 A1 2/2012 Mehta et al.
2012/0101017 A1 4/2012 Duggal
2012/0186225 A1 7/2012 Amann et al.
2013/0035841 A1 2/2013 Glugla et al.
2014/0187453 A1 7/2014 Umehara et al.
2014/0187455 A1 7/2014 Umehara et al.
2014/0194329 A1 7/2014 Shimizu et al.
2015/0322367 A1 11/2015 Patel et al.
2015/0322369 A1 11/2015 Patel et al.
2016/0230116 A1 8/2016 Mosier et al.
2016/0264908 A1 9/2016 Jones et al.
2016/0281020 A1 9/2016 Yamamoto et al.
2017/0015926 A1 1/2017 Fletcher et al.
2017/0015930 A1 1/2017 Fletcher
2017/0022441 A1 1/2017 Onodera
2017/0175027 A1 6/2017 Gieselman
2017/0292083 A1* 10/2017 Diegelmann ..... C10M 133/46
2018/0002631 A1 1/2018 Milner
2018/0346389 A1* 12/2018 Castellani ..... C05D 9/02
2018/0355274 A1 12/2018 Koyama
2021/0002577 A1 1/2021 Mosier et al.
2021/0024848 A1 1/2021 Saccomando et al.
2021/0371767 A1 12/2021 Shimizu et al.
2022/0186137 A1 6/2022 Utaka
2022/0213401 A1 7/2022 Chommeloux et al.
2022/0220410 A1 7/2022 Ruhe, Jr. et al.
2022/0289771 A1 9/2022 Zhuang et al.
2022/0389345 A1* 12/2022 Shao ..... C10M 125/10
2022/0411713 A1 12/2022 Neville et al.
2023/0120889 A1 4/2023 Matsubara et al.

(56) References Cited

U.S. PATENT DOCUMENTS

| | | | |
|---|---|---|---|
| 2024/0026242 | A1 | 1/2024 | Yoshida et al. |
| 2024/0101923 | A1 | 3/2024 | Fuchi et al. |

FOREIGN PATENT DOCUMENTS

| | | | |
|---|---|---|---|
| CN | 115010751 | A | 9/2022 |
| CN | 111057108 | B | 8/2023 |
| CN | 111057111 | B | 8/2023 |
| EP | 88453 | A1 | 9/1983 |
| EP | 612839 | A1 | 8/1994 |
| EP | 1788068 | A1 | 5/2007 |
| EP | 1985690 | A2 | 10/2008 |
| EP | 2639433 | A1 | 9/2013 |
| GB | 961009 | | 6/1964 |
| GB | 1162334 | | 8/1969 |
| JP | 2014152301 | A | 8/2014 |
| JP | 2016534216 | A | 11/2016 |
| JP | 2017514984 | A | 6/2017 |
| JP | 2017149830 | A | 8/2017 |
| JP | 201821107 | A | 2/2018 |
| JP | 2018168344 | A | 11/2018 |
| JP | 7312717 | B2 | 7/2023 |
| WO | 2009104682 | A1 | 8/2009 |
| WO | 2015023559 | A1 | 2/2015 |
| WO | 2015042337 | A1 | 3/2015 |
| WO | 2015042340 | A1 | 3/2015 |
| WO | 2015042341 | A1 | 3/2015 |
| WO | 2015076417 | A1 | 5/2015 |
| WO | 20150114920 | A1 | 8/2015 |
| WO | 2017011691 | A1 | 1/2017 |
| WO | 2017083546 | A1 | 5/2017 |
| WO | 2019155739 | A1 | 8/2019 |
| WO | 2020085153 | A1 | 4/2020 |
| WO | 2020085228 | A1 | 4/2020 |
| WO | 2021064059 | A1 | 4/2021 |
| WO | 2022097357 | A1 | 5/2022 |
| WO | 2022128802 | A1 | 6/2022 |
| WO | 2023156989 | A1 | 8/2023 |
| WO | 2023161795 | A1 | 8/2023 |

OTHER PUBLICATIONS

Takeuchi et al., Investigation of Engine Oil Effect on Abnormal Combustion in Turbocharged Direct Injection-Spark Ignition Engines, SAE Int., Nov. 2012, vol. 5, Issue 3. (Abstract).

W. W. Yau, J. J. Kirkland and D. D. Bly, "Modern Size Exclusion Liquid Chromatography", John Wiley and Sons, New York, 1979.

International Search Report and Written Opinion issued in Application No. PCT/US2023/084180 mailed on Apr. 8, 2024, 12 pages.

* cited by examiner

LOW-ASH LUBRICATING COMPOSITIONS

TECHNICAL FIELD

This disclosure relates to low-ash additive systems and lubricating compositions including the low-ash additive systems for passenger car engines.

BACKGROUND

Automotive manufacturers continue to push for improved efficiency and fuel economy, and as such, demands on engines, lubricants, and their components continue to increase. It is well known that lubricating oils contain a number of additives to protect engines from wear, oxidation, soot, and/or acid build-up to suggest a few performance features of common lubricant additives. One conventional additive for passenger car engine oils has been metal-containing antiwear compounds, such as zinc dialkyldithiophosphate (ZDDP), that protects engine components, for example, by forming a protective layer on metal surfaces and, in many applications, has been a mainstay additive in passenger car lubricating compositions to achieve performance in numerous engine oil tests. ZDDP has been a versatile multi-functional additive that can function, for instance, as an antiwear additive, an extreme pressure agent, an oxidation inhibitor, and/or a corrosion inhibitor. While being a common additive in passenger car engine oils, metal-containing compounds like ZDDP additives, however, also contribute to the ash content of lubricating oil compositions, and there has been a push in recent years to decrease the levels of ash contributions from a lubricant for a number of reasons. Unfortunately, removing or decreasing the levels of metal-containing antiwear additives like ZDDP in engine oils can be detrimental to many performance goals and, thus, simply reducing or eliminating ZDDP, and still meeting the heightened demands of manufacturer and industry performance standards, tends to be challenging.

SUMMARY

In one approach or embodiment, a passenger car lubricating composition having a lower sulfated ash content is described herein. In one aspect, the passenger car lubricating composition includes one or more base oils of lubricating viscosity; an antiwear system including one or more ashless phosphorus-containing antiwear compounds and, optionally, one or more metal-containing antiwear compounds, and wherein a phosphorus weight ratio of phosphorus from the one or more ashless antiwear compounds to phosphorus from the one or more optional metal-containing antiwear compounds is about 50:50 to about 100:0; a sulfated ash content of about 0.75 weight percent or less as measured pursuant to ASTM D874; about 700 ppm or less of total phosphorus contributed by the one or more ashless phosphorus-containing antiwear compounds and the optional one or more metal-containing antiwear compounds; a detergent system having a weight ratio of magnesium-to-calcium of about 2.0 or less; and a TBN ratio of TBN measured per ASTM D4739 relative to TBN measured per ASTM D2896 of at least about 60 percent.

In other approaches or embodiments, the passenger car lubricating composition of the previous paragraph includes one or more other aspects or embodiments in any combination. These other approaches or embodiments includes one or more of the following: wherein the TBN ratio is about 60 percent to about 70 percent when the sulfated ash is less than about 0.5 weight percent, and/or wherein the TBN ratio is greater than 70 to about 80 percent when the sulfated ash is greater than 0.5 weight percent; and/or wherein a ratio of zinc in ppm to weight percent total SASH (ASTM D874) is less than about 400 when the total SASH is less than about 0.5 weight percent; and/or wherein the ashless phosphorus-containing antiwear additive is a dialkyl dithiophosphate ester, a triester of a dithiophosphate, an amyl acid phosphate, a diamyl acid phosphate, a dibutyl hydrogen phosphonate, a dimethyl octadecyl phosphonate, salts thereof, or mixtures thereof; and/or wherein the one or more ashless phosphorus-containing antiwear additive is a dialkyl dithiophosphate antiwear additive having a structure of Formula I, or a salt thereof:

(Formula I)

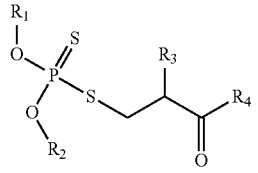

wherein $R_1$ and $R_2$ of Formula I are, independently, a C3 to C8 linear or branched alkyl group, $R_3$ of Formula I is hydrogen or methyl, and $R_4$ of Formula I is a hydroxy group or a hydrocarbyl group; and/or wherein the ashless phosphorus-containing antiwear additive is a triester of a dithiophosphate having two oxygen ester moieties and a sulfur ester moiety; and wherein each oxygen ester moiety, independently, includes at least 2 or more β-hydrogens on a linear or branched hydrocarbyl group; wherein the sulfur ester moiety includes one or more heteroatoms selected from oxygen or nitrogen and having up to 4 carbon atoms linking at least one of the heteroatoms to the sulfur atom of the sulfur ester; and wherein the ashless phosphorus-containing antiwear additive has a molecular weight of at least about 490 g/mol; and/or wherein the triester of a dithiophosphate has the structure of Formula II:

(Formula II)

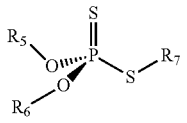

wherein $R_5$ and $R_6$ of Formula II include the oxygen ester moieties and, independently, a linear or branched C3 to C100 hydrocarbyl group; and $R_7$ of Formula II includes the sulfur ester moiety with a C3 to C100 linear or branched hydrocarbyl group including the one or more heteroatoms; and/or wherein the oxygen ester moieties of $R_5$ and $R_6$ from Formula II are, independently, derived from one of 4-methyl-2-pentyl alcohol, isopropyl alcohol, tert-butyl alcohol, sec-butyl alcohol, 2-octanol, 2-decanol, 2-dodecanol, or combinations thereof; and/or wherein the sulfur ester moiety of $R_7$ of Formula II is derived from one of (i) a vinyl ester of a carboxylic acid and selected from vinyl acetate, vinyl propionate, vinyl laurate, vinyl octanoate, vinyl decanoate, vinyl stearate, or combinations thereof; (ii) a maleic acid, ester, diester or anhydride thereof and selected from vinyl acetate, vinyl propionate, vinyl laurate, vinyl octanoate, vinyl decanoate, vinyl stearate, or combinations thereof; (iii) an alkyl (meth)acrylate and selected from methyl acrylate, methyl methacrylate, ethyl acrylate, ethyl methacrylate, butyl acrylate, butyl methacrylate, or combinations thereof; or (iv) combinations thereof; and/or wherein the triester of a dithiophosphate includes each oxygen ester derived from 4-methyl-2-pentyl alcohol and the sulfur ester derived from dibutyl maleate; and/or wherein the molecular weight of the ashless phosphorus-containing antiwear additive is up to about 650 g/mol; and/or wherein the metal-containing antiwear additive is one or more zinc dihydrocarbyl dithiophosphate compounds; and/or wherein the zinc dihydrocarbyl dithiophosphate compound is derived from at least about 60 weight percent secondary alcohols; and/or wherein the one or more zinc dihydrocarbyl dithiophosphate compounds have a structure of Formula III:

(Formula III)

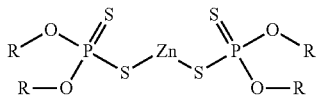

wherein each R group of Formula III is, independently, a linear or branched C3 to C16 hydrocarbyl group; and/or wherein each R group of Formula III is, independently, a linear or branched C4 to C8 hydrocarbyl group; and/or wherein the hydrocarbyl groups of the one or more zinc dihydrocarbyl dithiophosphate compounds are selected from one or more of ethylhexyl groups, butyl groups, methyl isobutyl groups, pentyl groups, methyl pentyl groups, isopentyl groups, isobutyl groups, propyl groups, isopropyl groups, or combinations thereof; and/or wherein the ashless phosphorus-containing antiwear compounds and the optional metal-containing antiwear compounds contribute a total of about 350 ppm or less phosphorus; and/or wherein the passenger car lubricating composition lubricates a hybrid-electric passenger car engine; and/or wherein the passenger car lubricating composition exhibits a rust rating of 70 AGV or greater in the Ball Rust Test of ASTM D6557; and/or wherein the passenger car lubricating composition has about 330 ppm or less of total copper, lead, and tin combined pursuant to the high temperature corrosion bench test (HTCBT) of ASTM D6594; and/or wherein the passenger car lubricating composition exhibits emulsion stability with 0 percent water separation at 0° C. and/or 25° C. pursuant to ASTM D7563; and/or wherein the detergent system includes an overbased calcium sulfonate detergent and an overbased magnesium sulfonate detergent contributing about 200 to about 1000 ppm calcium and about 500 to about 1500 ppm magnesium to the passenger car lubricating composition; and/or wherein the detergent system has a weight ratio of magnesium to calcium of at least about 1.0.

In yet other approaches or embodiments, methods of lubricating a passenger car engine are also disclosed herein. In aspects, the methods include lubricating the crankcase of a passenger car engine with any embodiment of the passenger car lubricating composition having a low sulfated ash content as described in the previous two paragraphs.

In yet other approaches or embodiments, the use of a passenger car lubricating composition having a lower sulfated ash content from any embodiment of this Summary is also described for achieving one or more of (i) a rust rating of 70 AGV or greater in the Ball Rust Test of ASTM D6557; and/or (ii) about 330 ppm or less of total copper, lead, and tin combined pursuant to the high temperature corrosion bench test (HTCBT) of ASTM D6594; and/or (ii) emulsion stability with 0 percent water separation at 0° C. and/or 25° C. pursuant to ASTM D7563.

Additional details and advantages of the disclosure will be set forth in part in the description that follows, and/or may be learned by practice of the disclosure. The details and advantages of the disclosure may be realized and attained by means of the elements and combinations particularly pointed out in the appended claims. It is to be understood that both the foregoing general description and the following detailed description are exemplary and explanatory only and are not restrictive of the disclosure, as claimed.

BRIEF DESCRIPTION OF DRAWING FIGURES

DETAILED DESCRIPTION

Figure 1:
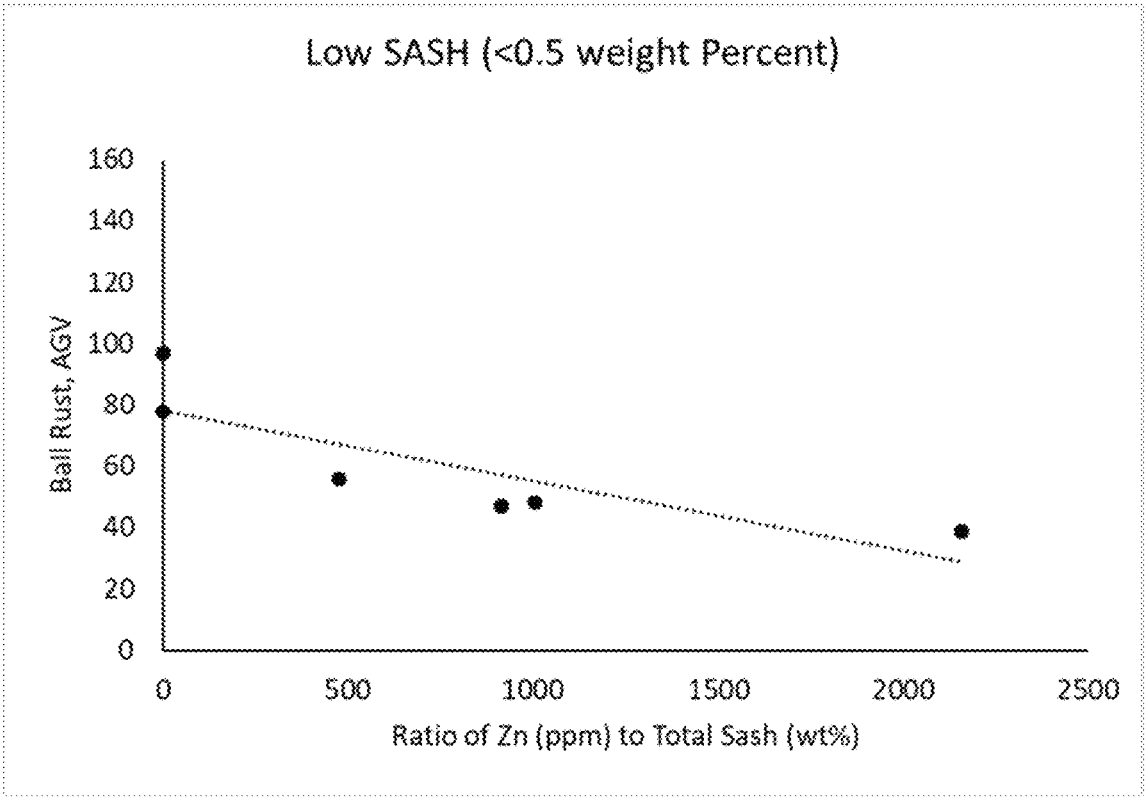
FIG. 1 is a graph of ball rust performance of lower SASH lubricating compositions relative to a ratio of zinc to total SASH.

In one aspect, the present application describes passenger car lubricating compositions having a lower ash content due, in part, by reducing or eliminating the amount of metal-containing antiwear compounds, such as zinc dialkyldithiophosphate (ZDDP) additives, in the compositions. Sulfated ash is a measurement that indicates the total weight percent of ash contributed by a lubricating oil composition, and the sulfated ash content of a lubricating oil composition is related to the total metal contribution of the various additives therein and may be conveniently measured according to ASTM D874 and/or other common evaluation methods known in the art and as described herein. As noted in the Background, while metal-containing antiwear additives, such as ZDDP, have been a mainstay additive in passenger car engine oils for a number of years, the metal (e.g., zinc) in such additives is one contributor to the ash content of lubricants; however, simply reducing or eliminating ZDDP in order to formulate lower ash contributing lubricating compositions often results in one or more shortcomings in achieving desired performance. For instance, and as shown in the Examples, reducing or eliminating metal-containing antiwear additives in passenger car lubricating compositions present challenges in achieving desired corrosion resistance (e.g., Ball Rust Test of ASTM D6557), stable emulsions (e.g., ASTM D7563) and/or low corrosion in the High Temperature Corrosion Bench Test (HTCBT) (e.g., ASTM D6594).

Discovered herein are passenger car lubricating compositions having lower levels of sulfated ash content that surprisingly achieves performance in multiple engine oil tests even when having reduced, and in some instances, no metal-containing antiwear compounds such as ZDDP. In one approach or embodiment, the compositions herein include one or more base oils of lubricating viscosity; an antiwear system including one or more ashless phosphorus-containing antiwear compounds and, optionally, one or more metal-containing antiwear compounds (but with a reduced amount of metal), and wherein a weight ratio of phosphorus contributed from the one or more ashless antiwear compounds to phosphorus contributed by one or more metal-containing antiwear compounds is about 25:75 to about 100:0, about 50:50 to about 100:0, about 75:25 to about 100:0, or about 25:75 to about 75:25 (or any other ranges therebetween); a measured sulfated ash content of about 0.75 weight percent or less pursuant to ASTM D874 (in other approaches, about 0.7 weight percent or less, about 0.6 weight percent or less, about 0.4 weight percent or less, or about 0.36 weight percent or less); and no more than about 700 ppm of total phosphorus contributed by the one or more ashless phosphorus-containing antiwear compounds and, if included, the optional one or more metal-containing antiwear compounds (in other approaches, no more than 600 ppm, no more than 500 ppm, no more than 400 ppm, no more than 350 ppm phosphorus, or no more than 300 ppm phosphorus). In other embodiments, the compositions herein, in some approaches, may also balance zinc levels relative to the total SASH contributions such that when the compositions have less than 0.5 weight percent total SASH, then the compositions also have less than about 300 ppm of total zinc and/or also exhibit a relationship of the zinc in ppm to the total SASH reflected by a ratio of less than about 400 ppm of zinc to weight percent total SASH.

In other embodiments, it was also discovered that when using the antiwear systems as described herein to reduce ash contributions, the passenger car lubricating compositions of the present disclosure also needed a certain TBN profile matched to the antiwear systems. In one approach and as highlighted by the Examples, the lubricating compositions of the present disclosure have a TBN ratio of TBN per ASTM D4739 relative to TBN per ASTM D2896 of at least about 60 percent. As shown in the Examples, such TBN relationship combined with the selected antiwear system for reduced ash content, at least in some embodiments, aids in achieving performance in the context of the compositions having the lower ash contributing antiwear system noted above. In yet other embodiments, it was discovered that the TBN ratio is about 60 percent to about 70 percent when the sulfated ash content is measured at less than about 0.5 weight percent, and/or that the TBN ratio is greater than 70 to about 80 percent when the sulfated ash content is measured at about 0.5 weight percent or more (e.g., about 0.5 to about 0.75 weight percent).

Ashless Phosphorus-Containing Antiwear Compound

The antiwear systems of the passenger car lubricating compositions herein include one or more ashless phosphorus-containing antiwear compounds. In one approach or embodiment, the ashless phosphorus-containing antiwear compound may be selected from a dialkyl dithiophosphate ester, a triester of a dithiophosphate, an amyl acid phosphate, a diamyl acid phosphate, a dibutyl hydrogen phosphonate, a dimethyl octadecyl phosphonate, salts thereof, or mixtures thereof.

In some embodiments, the ashless phosphorus-containing antiwear compound is an acidic thiophosphate, a thiophosphate ester, or a sulfur-containing phosphoric acid esters and may have one or more sulfur to phosphorus bonds. The thiophosphorus acid esters may be dithiophosphorus acid esters. In more specific approaches, the acidic thiophosphate or thiophosphate ester may have a structure of Formula I or a salt thereof (Formula I)

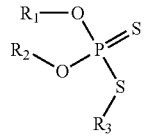

wherein $R_1$ and $R_2$ are each, independently, a linear or branched C1 to C10 hydrocarbyl group and $R_3$ is a C1 to C10 linear or branched carboxylic group or a C1 to C10 linear or branched alkyl alkanoate group. Preferably, $R_1$ and $R_2$ are each a C3 to C8 linear or branched alkyl group and $R_3$ is derived from 2-methyl proponoic acid such that the second phosphorus product (or a salt thereof) has the structure of Formula Ia below:

(Formula Ia)

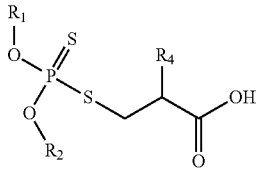

wherein $R_1$ and $R_2$ are, independently, a C3 to C8 linear or branched alkyl group (preferably, a branched C4 group), and $R_4$ is —H or —$CH_3$. In some approaches or embodiments, the one or more ashless phosphorus-containing antiwear compound includes at least 3-[[bis (2-methylpropoxy) phosphinothioyl]thio]-2-methylpropanoic acid.

In other embodiments, the ashless phosphorus-containing antiwear compound is a triester of a dithiophosphate having a select structure in which the compound includes two select oxygen ester moieties and a select sulfur ester moiety. In one approach, each oxygen ester moiety, independently, includes a linear or branched hydrocarbyl group having at least 2 or more β-hydrogens, and the sulfur ester moiety includes a linear or branched hydrocarbyl group and includes one or more heteroatoms selected from oxygen or nitrogen with up to 4 carbon atoms linking at least one of the heteroatoms to the sulfur atom of the sulfur ester.

In some approaches, suitable triesters of a dithiophosphate additive for the ashless phosphorus-containing antiwear compound may also have a minimum molecular weight of at least about 490 g/mol and have the structure of Formula II:

(Formula II)

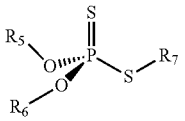

wherein $R_5$ and $R_6$ represent the oxygen ester moieties and, independently, include a linear or branched C3 to C100 hydrocarbyl group having 2 or more β-hydrogens (preferably, 2 to 6 β-hydrogens); and $R_7$ represents the sulfur ester moiety and includes a C3 to C100 linear or branched hydrocarbyl group including one or more heteroatoms selected from oxygen or nitrogen and having up to 4 carbon atoms linking at least one of the heteroatoms to the sulfur atom of the sulfur ester. At noted above, the compound of Formula II also has a minimum molecular weight of at least about 490 g/mol, and in other embodiments, about 490 g/mol to about 650 g/mol, in yet other embodiments, about 490 g/mol to about 640 g/mol, or about 490 g/mol to about 620 g/mol.

In one approach, the oxygen ester moieties (e.g., $R_5$ and $R_6$ of Formula II) each include, independently, a linear or branched C3 to C100 hydrocarbyl group, in other approaches, a linear or branched C3 to C50 hydrocarbyl group, a linear or branched C3 to C20 hydrocarbyl group, or preferably a linear or branched C6 to C10 hydrocarbyl group, or most preferably a linear or branched C6 to C8 hydrocarbyl group where each linear or branched hydrocarbyl group includes at least 2 β-hydrogens (or 2 to 9 β-hydrogens, preferably 2 to 6 β-hydrogens, more preferably 2 to 5 β-hydrogens, and most preferably 5 β-hydrogens) in the hydrocarbyl group. As known to those of ordinary skill, a β-hydrogen refers to any hydrogen on the β-carbon of the hydrocarbyl group with the α-carbon being the carbon atom bonded to the oxygen atom of the dithiophosphate (i.e., the α-carbon is the carbon bonded to the hydroxyl group in the alcohol used to form the oxygen esters).

In other approaches or embodiments, the oxygen ester moieties $R_5$ and $R_6$ of Formula II above are, independently, derived from one or more secondary alcohols providing the noted levels of β-hydrogens. For instance, suitable secondary alcohols used to form the oxygen ester moieties include, but are not limited to, 4-methyl-2-pentyl alcohol (providing 5 β-hydrogens), isopropyl alcohol (providing 6 β-hydrogens), tert-butyl alcohol (providing 9 β-hydrogens), sec-butyl alcohol (providing 5β-hydrogens), 2-octanol (providing 5 β-hydrogens), 2-decanol (providing 5β-hydrogens), 2-dodecanol (providing 5 β-hydrogens), or combinations thereof. Preferably, the oxygen esters of Formula II are each derived from 4-methyl-2-pentyl alcohol providing 5 β-hydrogens in each of the oxygen ester groups; however, selection of this preferred oxygen esters also needs to be matched with a suitable sulfur ester moiety to derive the noted minimum molecular weights for the additive to achieve performance.

In another approach or embodiment, the sulfur ester moiety (e.g., $R_7$ of Formula II) includes a linear or branched C3 to C100 hydrocarbyl group (in other approaches, a linear or branched C3 to C50 hydrocarbyl group, or a linear or branched C3 to C30 hydrocarbyl group) including one or more heteroatoms selected from oxygen or nitrogen (preferably oxygen) and having up to 4 carbon atoms linking at least one of the heteroatoms (preferably the oxygen atom) to the sulfur atom of the sulfur ester moiety. In other approaches, the sulfur ester has up to 2 carbon atoms linking the heteroatom to the sulfur atom, or preferably 1 or 2 carbon atoms. The sulfur ester moiety may also include in other embodiments, as needed, one or more carbonyl groups in its hydrocarbyl chain.

In one approach or embodiment, the sulfur ester moiety represented by $R_7$ in Formula II above is derived, for instance, from one of (i) a vinyl ester; (ii) an unsaturated carboxylic acid, ester, diester, or anhydride thereof; (iii) an alkyl (meth)acrylate, or (iv) combinations thereof. In addition, the sulfur ester moiety needs to be selected in combination with the particular oxygen ester moieties noted above to achieve the minimum molecular weights of the additive of at least about 490 g/mol.

In one embodiment, the sulfur ester moiety of $R_7$ of Formula I may be derived from a vinyl ester. In this approach, suitable vinyl esters include vinyl esters of carboxylic acids and may include, but are not limited to, vinyl acetate, vinyl propionate, vinyl laurate, vinyl octanoate, vinyl decanoate, vinyl stearate, or the like, or combinations thereof. If the sulfur ester moiety is formed from the vinyl ester, then again, the vinyl ester also needs to have a sufficient carboxylic acid portion when used in conjunction with the appropriate oxygen ester moieties to meet the minimum molecular weights noted above to achieve wear and phosphorus retention performance. In a preferred embodiment, the sulfur ester moiety may be derived from vinyl laurate (and most preferably vinyl laurate combined with each oxygen ester derived from 4-methyl-2-pentyl alcohol). In another embodiment, the sulfur ester moiety may be derived from vinyl stearate.

In another embodiment, the sulfur ester moiety of $R_7$ may be derived from an unsaturated carboxylic acid, ester, diester, or anhydride thereof. For instance, the unsaturated carboxylic acid, ester, diester, or anhydride may be maleic acid, fumaric acid, an ester, a diester, or an anhydride thereof. For instance, suitable unsaturated acids, esters, or anhydrides may include, but are not limited to, methyl maleate, dimethyl maleate, ethyl maleate, diethyl maleate, butyl maleate, dibutyl maleate, diphenyl maleate, methyl fumarate, dimethyl fumarate, ethyl fumarate, diethyl fumarate, butyl fumarate, dibutyl fumarate, diphenyl fumarate, combinations thereof, anhydrides thereof, or the like, or combinations thereof. If the sulfur ester moiety is formed from the unsaturated carboxylic acid, ester, diester, or anhydride, then again, the desired acid, ester, or anhydride needs to be selected in conjunction with the appropriate oxygen ester moieties discussed above to meet the minimum molecular weights noted above to achieve wear and phosphorus retention performance. In a preferred embodiment, the sulfur ester moiety may be derived from dibutyl maleate (and most preferably dibutyl maleate combined with each oxygen ester derived from 4-methyl-2-pentyl alcohol).

In yet another embodiment, the sulfur ester moiety of $R_7$ may be derived from an alkyl (meth)acrylate. In this approach, suitable alkyl (meth)acrylates may include, but are not limited to, methyl acrylate, methyl methacrylate, ethyl acrylate, ethyl methacrylate, butyl acrylate, butyl methacrylate, or the like, or combinations thereof. As with the other approaches of the sulfur ester moiety, if the sulfur ester moiety is formed from the alkyl (meth)acrylate, then again, the desired alkyl (meth)acrylate needs to be selected in conjunction with the appropriate oxygen ester moieties to meet the minimum molecular weights noted above to achieve wear and phosphorus retention performance.

The ashless phosphorus-containing antiwear compound herein can be prepared in a number of ways, but preferably are prepared by first reacting a selected secondary alcohol with phosphorus pentasulfide. In some approaches, the phosphorus pentasulfide may be a monomer or dimer thereof. The reaction of the selected secondary alcohol with phosphorus pentasulfide forms an intermediate dialkyl dithiophosphoric acid, which is then further reacted in a second step with the selected organic compound to form the sulfur ester moiety, which is preferably one of (i) the vinyl ester; (ii) the unsaturated carboxylic acid, ester, diester, or anhydride thereof; (iii) the alkyl (meth)acrylate, or (iv) combinations thereof to form the ashless antiwear additives of the present application. The reaction of this second step may be carried out at about 70° C. to about 150° C. for about 2 to about 24 hours or as needed to achieve the desired final product.

In one exemplary approach or embodiment, the ashless phosphorus-containing antiwear compound herein may be prepared by reacting, in a first reaction step, the above-described secondary alcohol (preferably 4-methyl-2-pentyl alcohol for instance) and the phosphorus pentasulfide in a molar ratio of the secondary alcohol to the phosphorus pentasulfide of about 1:1 to about 20:1, or about 2:1 to about 15:1, or about 3:1 to about 10:1, or about 3.5:1 to about 7:1, or about 3.5:1 to about 5:1, to form the above-described intermediate reaction product. The intermediate reaction product is then further reacted, in a second reaction step, with the above-described organic compound (preferably, vinyl stearate or dibutyl maleate for instance) with a molar ratio of the selected organic compound to the secondary alcohol of about 0.1:1 to about 10:1, or about 0.3:1 to about 5:1, or about 0.5:1 to about 1:1. Resultant product may include, in some embodiments using the preferred reactants, one or more of, 1-((bis((4-methylpentan-2-yl)oxy) phosphorothioyl)thio)ethyl stearate or dibutyl 2-((bis((4-methylpentan-2-yl)oxy) phosphorothioyl)thio)succinate.

In one approach and, based on the preferred selections of the oxygen ester moieties (e.g., secondary alcohols) and the sulfur ester moiety (organic reactants for the second reaction step), suitable examples of the ashless phosphorus-containing antiwear compound of the present disclosure include those of Formulas IIa and IIb below derived from 4-methyl-2-pentyl alcohol forming the oxygen ester moieties (with 5 β-hydrogens in each oxygen ester moiety) and either vinyl stearate or dibutyl maleate forming the sulfur ester moieties:

(Formula IIa)

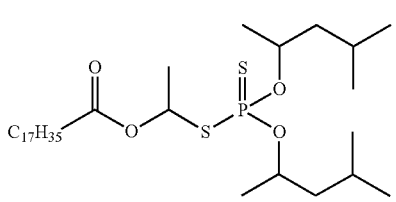

The exemplary compound of Formula IIa is derived from vinyl stearate, 4-methyl-2-pentyl alcohol, and phosphorus pentasulfide. The additive of Formula IIa has 5 β-hydrogens in the oxygen ester moiety, about 5.1 weight percent phosphorus, and has a number average molecular weight of 609.

(Formula IIb)

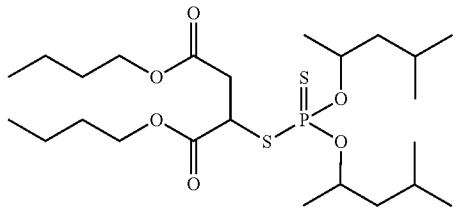

The exemplary compound of Formula IIb is derived from dibutyl maleate, 4-methyl-2-pentyl alcohol, and phosphorus pentasulfide. The additive of Formula IIb also has 5 β-hydrogens in each oxygen ester moiety, about 5.9 weight percent phosphorus, and has a number average molecular weight of 527. Other suitable ashless antiwear additives can be formed in a similar reaction scheme upon selecting the appropriate starting secondary alcohol and appropriate organic reactant for the second step pursuant to constructs set forth above to derive additives having the noted numbers of β-hydrogens and minimum molecular weight.

In approaches and embodiments herein, the ashless phosphorus-containing antiwear compound compounds may preferably be used in the passenger car lubricating compositions in amounts of about 0.01 to about 10 weight percent, in other approaches, about 0.1 to about 5.0 weight percent, and in further approaches, about 0.2 to about 3.0 weight percent, about 0.2 to about 2.0 weight percent, or about 0.25 weight percent to about 1.5 weight percent. The ashless phosphorus-containing antiwear compounds may herein may also provide a selected amount of phosphorus to the passenger car lubricating composition. In embodiments, for instance, the ashless phosphorus-containing antiwear compound may provide about up to about 700 ppm of phosphorus, up to about 600 ppm phosphorus, up to about 500 ppm phosphorus, up to about 400 ppm phosphorus, up to about 300 ppm of phosphorus, up to about 200 ppm phosphorus, or up to about 150 ppm phosphorus, or about 100 to about 700 ppm phosphorus, or about 120 to about 680 ppm of phosphorus, or about 150 to about 300 ppm of phosphorus. As noted above, the ashless phosphorus-containing antiwear compounds are provided at phosphorus ratios of about 25:75 to about 100:0 (or other ratios as noted in the embodiments above) in terms of phosphorus content provided from the ashless phosphorus-containing antiwear compounds relative to phosphorus content of any metal-containing phosphorus compounds.

Optional Metal-Containing Antiwear Compounds

In yet other embodiments, the antiwear systems of the compositions herein may also include one or more optional metal-containing antiwear compounds and, if used, may be reduced levels of a metal phosphate, a metal thiophosphate, a metal dialkyl dialkyldithiophosphate, or combinations thereof and with the metal selected from aluminum, lead, tin, molybdenum, manganese, nickel, copper, titanium, zinc, or combinations thereof. In one embodiment, the optional metal-containing antiwear compound is one or more dihydrocarbyl dithiophosphate compounds, and preferably, one or more metal dihydrocarbyl dithiophosphate compounds, and more preferably, one or more zinc dihydrocarbyl dithiophosphate compounds (ZDDPs). If included in the antiwear systems of the present disclosure, the one or more metal dihydrocarbyl dithiophosphate compounds provide no more than 350 ppm of phosphorus to the lubricant, no more than about 300 ppm phosphorus to the lubricant, no more than 250 ppm phosphorus to the lubricant, no more than 200 ppm phosphorus to the lubricant, or no more than 150 ppm phosphorus to the lubricant. In other approaches, the one or more metal dihydrocarbyl dithiophosphate compounds herein, if used, provide about 100 ppm to about 350 ppm phosphorus, or about 150 ppm to about 300 ppm phosphorus, or about 125 ppm to about 175 ppm phosphorus, or about 275 to about 325 ppm phosphorus. In yet other approaches, the one or more metal dihydrocarbyl dithiophosphate compounds of the antiwear systems herein, if used, provide no more than 400 ppm of metal (e.g., zinc) to the lubricant, no more than about 350 ppm metal (e.g. zinc) to the lubricant, no more than about 300 ppm metal (e.g. zinc) to the lubricant, or no more than about 200 ppm metal (e.g. zinc) to the lubricant. In other approaches, the one or more zinc dihydrocarbyl dithiophosphate compounds herein provide, if any, about 100 ppm to about 400 ppm metal (e.g. zinc), or about 150 ppm to about 350 ppm metal (e.g. zinc), or about 150 ppm to about 200 ppm metal (e.g. zinc), or about 300 to about 400 ppm metal (e.g. zinc). As discussed more below, the level of zinc may be balanced relative to the total SASH contributions of the lubricant. The ashless phosphorus-containing antiwear compounds discussed above are provided at phosphorus ratios of about 25:75 to about 100:0 (or other ratios noted above) in terms of phosphorus content provided from the ashless phosphorus-containing antiwear compounds relative to phosphorus content of the metal-containing phosphorus compounds, if included.

Suitable metal dihydrocarbyl dithiophosphates compounds may include about 5 to about 10 weight percent metal (such as, about 6 to about 10 weight percent metal), and about 10 to about 20 weight percent sulfur, (such as about 13 to about 20 weight percent sulfur, or about 14 to about 19 weight percent sulfur). Suitable metal dihydrocarbyl dithiophosphate compounds may include dihydrocarbyl dithiophosphate metal salts wherein the metal may be an alkali metal, alkaline earth metal, aluminum, lead, tin, molybdenum, manganese, nickel, copper, titanium, zirconium, zinc, or combinations thereof. Preferably, the metal is zinc.

The alkyl groups on the one or more metal dihydrocarbyl dithiophosphate compounds of the antiwear system herein may be derived from primary alcohols, secondary alcohols, phenols, and/or mixtures thereof. For example, primary alcohols may include, but are not limited to, isobutyl alcohol, amyl alcohol, or 2-ethylhexyl alcohol, and the like. Secondary alcohols may include, but are not limited to methyl isobutyl carbinol, isopropanol, and the like. In some optional embodiments, the metal dihydrocarbyl dithiophosphate compounds includes at least about 50 weight percent of hydrocarbyl groups derived from secondary alcohols, or more preferably, at least about 65 weight percent of the hydrocarbyl groups derived from the secondary alcohols, at least about 80 weight percent of hydrocarbyl groups derived from secondary alcohols, or about 100 percent of hydrocarbyl groups derived from secondary alcohols. In yet other optional embodiments, the antiwear system includes about 50 weight percent to about 100 weight percent of hydrocarbyl groups derived from secondary alcohols, and more preferably about 65 weight percent to about 100 weight percent of hydrocarbyl groups derived from the secondary alcohols, and even more preferably, about 80 weight percent to about 100 weight percent of hydrocarbyl groups derived from secondary alcohols. In some embodiments, examples of suitable metal dihydrocarbyl dithiophosphate compounds may include, but are not limited to, zinc O,O-di($C_{8-14}$-alkyl) dithiophosphate; zinc O,O-bis(2-ethylhexyl) dithiophosphate; zinc O,O-diisooctyl dithiophosphate; zinc O,O-bis (dodecylphenyl) dithiophosphate; zinc O,O-diisodecyl dithiophosphate; zinc O,O-bis(6-methylheptyl) dithiophosphate; zinc O,O-dioctyl dithiophosphate; zinc O,O-dipentyl dithiophosphate; zinc O-(2-methylbutyl)-O-(2-methylpropyl)dithiophosphate; and zinc O-(3-methylbutyl)-O-(2-methylpropyl)dithiophosphate; zinc O,O-bis(4-methyl-2-pentyl) dithiophosphate; or combinations thereof.

In yet approaches or embodiments, the metal dihydrocarbyl dithiophosphate compound suitable for antiwear systems herein may also have a structure of Formula III:

(Formula III)

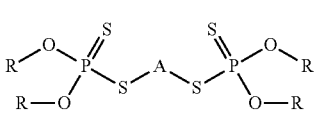

wherein each R in Formula III, independently, contains from 3 to 18 carbon atoms, or 3 to 12 carbon atoms, or about 3 to 10 carbon atoms so long as each phosphorus atom has, on average, at least 10 total carbons, and preferably at least 12 total carbons or 10 to 12 carbons. For example, each R may, independently, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl, methyl-pentyl, and/or 4-methyl-2-pentyl, or combinations thereof. The number of carbon atoms in each R group in the formula above will generally be about 3 or greater, about 4 or greater, about 6 or greater, or about 8 or greater. In Formula III, A is a metal, such as aluminum, lead, tin, molybdenum, manganese, nickel, copper, titanium, zirconium, zinc, or combinations thereof and, preferably, A is zinc. When the metal dihydrocarbyl dithiophosphate compound has the structure shown in Formula III and with A being zinc, the compound may have about 4 to about 9 weight percent phosphorus and about 6 to about 10 weight percent zinc.

In other approaches or embodiments, it is understood in the art that a more accurate representation of the sulfur-zinc coordination arrangement may be represented by the symmetrical arrangement shown below with the chemical structure of Formula IIIa that may be used herein as interchangeable with Formula III shown above. It is also understood that the structures shown in Formulas I and II may be present as monomer, dimer, trimer, or oligomer (such as a tetramer).

(Formula IIIa)

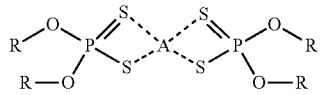

Dihydrocarbyl dithiophosphate metal salts may be prepared in accordance with known techniques by first forming a dihydrocarbyl dithiophosphoric acid (DDPA), usually by reaction of one or more alcohols or phenols with $P_2S_5$ and then neutralizing the formed DDPA with a metal compound, such as zinc oxide. For example, DDPA may be made by reacting mixtures of alcohols including the suitable amounts of primary alcohols and/or secondary alcohols with $P_2S_5$.

TBN Profile

It was discovered that when using the select antiwear systems of the present disclosure to reduce ash contributions, it is also preferred that lubricants, in some embodiments, also have a certain TBN profile matched to the selected antiwear system. In one approach and as highlighted by the Examples, the lubricants herein have a TBN ratio including TBN measured per ASTM D4739 relative to TBN measured per ASTM D2896 of at least about 60 percent. As shown in the Examples, such TBN profile combined with the selected antiwear systems for reduced ash content, at least in some embodiments, aid in achieving performance in the context of the compositions having the lower ash contributing antiwear system. In yet other embodiments, it was discovered that the TBN ratio is about 60 percent to about 70 percent when the sulfated ash content is measured at less than about 0.5 weight percent, or alternatively, that the TBN ratio is greater than 70 to about 80 percent when the sulfated ash content is measured at least about 0.5 weight percent (e.g., about 0.5 to about 0.75 weight percent) to achieve performance.

In another approach, the passenger car lubricating compositions herein include detergent systems contributing, in part, to the TBN ratio and, in preferred embodiments, by including magnesium and/or calcium-based detergents. Preferred TBN contributed by the additives of the detergent systems are at least 3 mg KOH/g, at least 4 mg KOH/g, at least 5 mg KOH/g or at least 6 mg/KOH/g to about 10 mg KOH/g or less, about 8 mg KOH/g or less, about 6 mg KOH/g or less with TBN of the additives measured by ASTM D4739. In embodiments, the detergent systems herein generally include one or more alkali or alkaline metal salts of sulfonates, phenates, calixarates, salixarates, salicylates, carboxylic acids, sulfurized derivatives thereof, or combinations thereof and can be neutral, low-based, or overbased so long as the noted TBN relationships described herein are satisfied. Preferably, the detergents are overbased magnesium and/or calcium-based detergents, and most preferably, overbased magnesium and/or calcium-based sulfonates.

Suitable detergents and their methods of preparation are described in greater detail in numerous patent publications, including U.S. Pat. Nos. 7,732,390; 4,165,291, and/or 4,206,062 (and references cited therein), which are incorporated herein by reference. The lubricant compositions herein may include about 0.1 to about 5 weight percent of individual and/or total detergent additives, and in other approaches, about 0.15 to about 3 weight percent, and in yet other approaches, about 0.2 to about 2.5 weight, or about 0.3 to about 2.0 weight percent percent of individual and/or total detergent additives so long as the detergent additives meet the sulfonate amounts and other TBN relationships noted herein.

The detergent systems herein may provide an amount of total detergent metals (preferably, calcium and magnesium) that is greater than about 250 ppm total metal based on the total lubricating composition, and in other approaches, about 250 ppm to about 2500 ppm total metals, about 300 ppm to about 2100 ppm total metal, about 350 ppm to about 2000 ppm total metal, about 400 ppm to about 1950 ppm, or about 400 ppm to about 1900 ppm total metals. In other approaches, the detergent metals are calcium, sodium and/or magnesium and preferably, calcium, sodium, and magnesium provided by sulfonates and, most preferably, only calcium, sodium, and/or magnesium sulfonates. Preferably, the detergent metals are calcium, magnesium, or combinations thereof.

Generally, suitable detergents in the system may include linear or branched alkali or alkaline earth metal salts, such as calcium, sodium, or magnesium, of petroleum sulfonic acids and long chain mono- or di-alkylaryl sulfonic acids with the aryl group being benzyl, tolyl, and xylyl and/or various phenates or derivatives of phenates. Examples of suitable detergents include, subject the required TBN relationships herein, low-based/neutral and overbased variations of the following detergents: calcium phenates, calcium sulfur containing phenates, calcium sulfonates, calcium calixarates, calcium salixarates, calcium salicylates, calcium carboxylic acids, calcium phosphorus acids, calcium mono- and/or di-thiophosphoric acids, calcium alkyl phenols, calcium sulfur coupled alkyl phenol compounds, calcium methylene bridged phenols, magnesium phenates, magnesium sulfur containing phenates, magnesium sulfonates, magnesium calixarates, magnesium salixarates, magnesium salicylates, magnesium carboxylic acids, magnesium phosphorus acids, magnesium mono- and/or di-thiophosphoric acids, magnesium alkyl phenols, magnesium sulfur coupled alkyl phenol compounds, magnesium methylene bridged phenols, sodium phenates, sodium sulfur containing phenates, sodium sulfonates, sodium calixarates, sodium salixarates, sodium salicylates, sodium carboxylic acids, sodium phosphorus acids, sodium mono- and/or di-thiophosphoric acids, sodium alkyl phenols, sodium sulfur coupled alkyl phenol compounds, or sodium methylene bridged phenols.

The detergent additives may be neutral, low-based, or overbased and, preferably, overbased detergents or mixtures of neutral to low-based together with the overbased detergents as needed to meet the minimum detergent TBN numbers and other relationships as noted above. As understood, overbased detergent additives are well-known in the art and may be alkali or alkaline earth metal overbased detergent additives. Such detergent additives may be prepared by reacting a metal oxide or metal hydroxide with a substrate and carbon dioxide gas. The substrate is typically an acid, for example, an acid such as an aliphatic substituted sulfonic acid, an aliphatic substituted carboxylic acid, or an aliphatic substituted phenol.

The term "overbased" relates to metal salts, such as metal salts of sulfonates, carboxylates, salicylates and/or phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the MR is one and in an overbased salt, MR, is greater than one. They are commonly referred to as overbased, hyperbased, or superbased salts and may be salts of organic sulfur acids, carboxylic acids, or phenols.

As used herein and unless specified otherwise, the term "TBN" is used to denote the Total Base Number in mg KOH/g of a detergent as an additive and as measured by the method of ASTM D4739. The detergent may be neutral to overbased. For example, a low-based to neutral detergent additive may have a total base number (TBN) of less than about 200 mg KOH/gram. In another example, an overbased detergent of the lubricating oil compositions herein may have a total base number (TBN) of about 200 mg KOH/gram or greater, or about 250 mg KOH/gram or greater, or about 350 mg KOH/gram or greater, or about 375 mg KOH/gram or greater, or about 400 mg KOH/gram or greater. The overbased detergent may have a metal to substrate ratio of from 1.1:1 or less, or from 2:1 or less, or from 4:1 or less, or from 5:1 or less, or from 7:1 or less, or from 10:1 or less, or from 12:1 or less, or from 15:1 or less, or from 20:1 or less.

Examples of suitable overbased detergents (so long as the TBN profiles and other relationships as noted herein are satisfied) include, but are not limited to, overbased calcium phenates, overbased calcium sulfur containing phenates, overbased calcium sulfonates, overbased calcium calixarates, overbased calcium salixarates, overbased calcium salicylates, overbased calcium carboxylic acids, overbased calcium phosphorus acids, overbased calcium mono- and/or di-thiophosphoric acids, overbased calcium alkyl phenols, overbased calcium sulfur coupled alkyl phenol compounds, overbased calcium methylene bridged phenols, overbased magnesium phenates, overbased magnesium sulfur containing phenates, overbased magnesium sulfonates, overbased magnesium calixarates, overbased magnesium salixarates, overbased magnesium salicylates, overbased magnesium carboxylic acids, overbased magnesium phosphorus acids, overbased magnesium mono- and/or di-thiophosphoric acids, overbased magnesium alkyl phenols, overbased magnesium sulfur coupled alkyl phenol compounds, or overbased magnesium methylene bridged phenols.

Optionally, when a low-based or neutral detergent is incorporated into the detergent system, it generally has a TBN of less than 200 mg KOH/g, up to 175 mg KOH/g, up to 150 mg KOH/g, up to 100 mg KOH/g, or up to 50 mg KOH/g. The low-based/neutral detergent may include a calcium or magnesium-containing detergent. Examples of suitable low-based/neutral detergent (so long as TBN relationships noted herein are satisfied) include, but are not limited to, calcium sulfonates, calcium phenates, calcium salicylates, magnesium sulfonates, magnesium phenates, and/or magnesium salicylates.

In some embodiments, the detergent used in the lubricants herein include at least an overbased calcium sulfonate, an overbased sodium sulfonate, and/or an overbased magnesium sulfonate with each having a total base number of 200 to 400 and, in other approaches, about 200 to about 350. The above described TBN values reflect those of finished detergent components that have been diluted in a base oil. In other approaches, the detergent systems include a blend of neutral to low-based and also overbased sulfonate detergents.

In other embodiments, the TBN of the detergents herein may reflect a neat or non-diluted version of the detergent component. For example, the fluids herein may include overbased calcium or sodium sulfonate as a neat additive having a TBN of about 300 to about 450, and in other approaches, about 380 to about 420, and/or overbased magnesium sulfonate as a neat additive having a TBN of about 500 to about 700, and in other approaches, about 600 to about 700.

More specifically, the detergent systems herein include neutral, low-based, and/or overbased detergents (preferably, neutral to overbased calcium sulfonate, neutral to overbased sodium sulfonate, and/or neutral to overbased magnesium sulfonate) to achieve a detergent additive TBN as measured by ASTM D4739 of at least 3 mg KOH/g, at least 4 mg KOH/g, at least 5 mg KOH/g or at least 6 mg/KOH/g to about 10 mg KOH/g or less, about 8 mg KOH/g or less, about 6 mg KOH/g or less as measured by ASTM D4739. As noted above and shown in the Examples, the lubricants also have a select TBN profile whereby a TBN ratio of the TBN measured per ASTM D4739 relative to the TBN measured per ASTM D2896 is at least about 60 percent. In other embodiments and shown in the Examples, it was also discovered that the TBN ratio is about 60 percent to about 70 percent when the sulfated ash content is measured at less than about 0.5 weight percent, or alternatively, that the TBN ratio is greater than 70 to about 80 percent when the sulfated ash content is measured at greater than 0.5 weight percent (e.g., about 0.5 to about 0.75 weight percent) to achieve performance.

The detergent system also provide at least one of calcium, sodium, magnesium, or combination thereof and, thus, one or more of the following metal contents:

Sodium: up to about 100 ppm sodium, up to about 75 ppm sodium, up to about 50 ppm sodium, up to about 25 ppm, sodium, up to about 10 ppm sodium, up to about 5 ppm sodium, or none.

Magnesium: at least about 90 ppm of magnesium, at least about 180 ppm of magnesium, at least about 200 ppm magnesium, at least about 300 ppm of magnesium, or at least about 400 ppm of magnesium (preferably about 90 to about 3,500 ppm of magnesium, about 180 ppm to about 3,000 ppm, about 200 ppm to about 2,000 ppm of magnesium, 300 ppm to about 1,500 ppm of magnesium, or about 400 ppm to about 1,300 ppm of magnesium, or about 500 to about 1300 ppm).

Calcium: at least about 90 ppm of calcium, at least about 180 ppm of calcium, at least about 200 ppm calcium, at least 300 ppm of calcium, or at least about 400 ppm of calcium (preferably about 90 to about 3,500 ppm of calcium, about 180 ppm to about 3,000 ppm, about 180 ppm to about 2,000 ppm of calcium, 200 ppm to about 1,500 ppm of calcium, or 300 ppm to about 1,000 ppm of calcium, or about 300 to about 800 ppm, or about 300 to about 700 ppm).

In some approaches, the detergent systems of the passenger car lubricating compositions herein may also have selected relationships of magnesium to calcium (e.g., the preferred detergent metals) in the systems herein. For instance, a magnesium-to-calcium ratio (preferably contributed by sulfonate detergents) may be less than about 2.0 and, preferably greater than about 1.0, and in some embodiments, the magnesium-to-calcium detergent ratio is about 1.1:1 to about 2.0:1, about 1.3:1 to about 2.0:1 or about 1.5:1 to about 2.0:1 or about 1.5:1 to about 1.9:1 (or other ranges therebetween).

The Low-Ash Passenger Car Lubricating Compositions

The low-ash passenger car lubricant compositions of the present disclosure are formulated to contribute lower levels of sulfated ash, and include the select antiwear systems and the select detergent systems providing a composition having the detergents and the antiwear additives to contribute sulfated ash levels (ASTM D874) of about 0.75 weight percent or less, about 0.7 weight percent or less, about 0.6 weight percent or less, about 0.5 weight percent or less, about 0.4 weight percent or less, or about 0.36 weight percent or less (ASTM D874). In other approaches, the lubricant compositions herein may also include additives that contribute about 0.05 weight percent or more of sulfated ash, about 0.1 weight percent or more, about 0.2 weight percent or more, or about 0.3 weight percent or more of sulfated ash when measured pursuant to ASTM D874.

As used herein, "sulfated ash" or "SASH" refers to the amount of sulfated ash as measured using ASTM D874. Alternatively, sulfated ash may also be calculated based on the amount of metals in the lubricant. For example, sulfated ash (SASH) may optionally be calculated based on the total metallic elements that contribute to SASH in the lubricant composition adjusted by factors for each metallic type. The metals that contribute to SASH include (along with the adjustment factor) barium (1.7), boron (3.22), calcium (3.4), copper (1.252), lead (1.464), lithium (7.92), magnesium (4.95), manganese (1.291), molybdenum (1.5), potassium (2.33), sodium (3.09), and zinc (1.5). Specifically, the ppmw content of each of the metallic elements present in a lubricating oil composition that is considered to contribute to sulfated ash is multiplied by its corresponding factor above; then, the product for each metallic element/factor adjustment is summed and the total is divided by 10,000 to calculate the weight percent of SASH in the lubricating compositions. Unless specified otherwise, all sulfated ash levels herein are measured using ASTM D874.

In some embodiments, the lubricating compositions herein include relationships that balance the detergent SASH contributions relative to the metal-containing antiwear SASH contributions, and in particular, balance the zinc amounts relative to the total SASH levels. For instance and in some embodiments, the compositions herein may balance total zinc levels in ppm relative to the total SASH contribution such that when the compositions have additives contributing less than about 0.5 weight percent total SASH (preferably, less than about 0.4 weight percent total SASH, or more preferably less than about 0.36 weight percent total SASH), then the compositions may also have less than about 300 ppm of total zinc (preferably, less than about 250 ppm total zinc or more preferably less than about 200 ppm total zinc) and/or exhibit a relationship of the zinc in ppm to the total SASH contributions reflected by a ratio of zinc to weight percent total SASH of less than about 400 ppm (or a ratio of less than about 300, less than about 200 or less than about 100) as generally shown in FIG. 1 and the Examples below.

Figure 2:
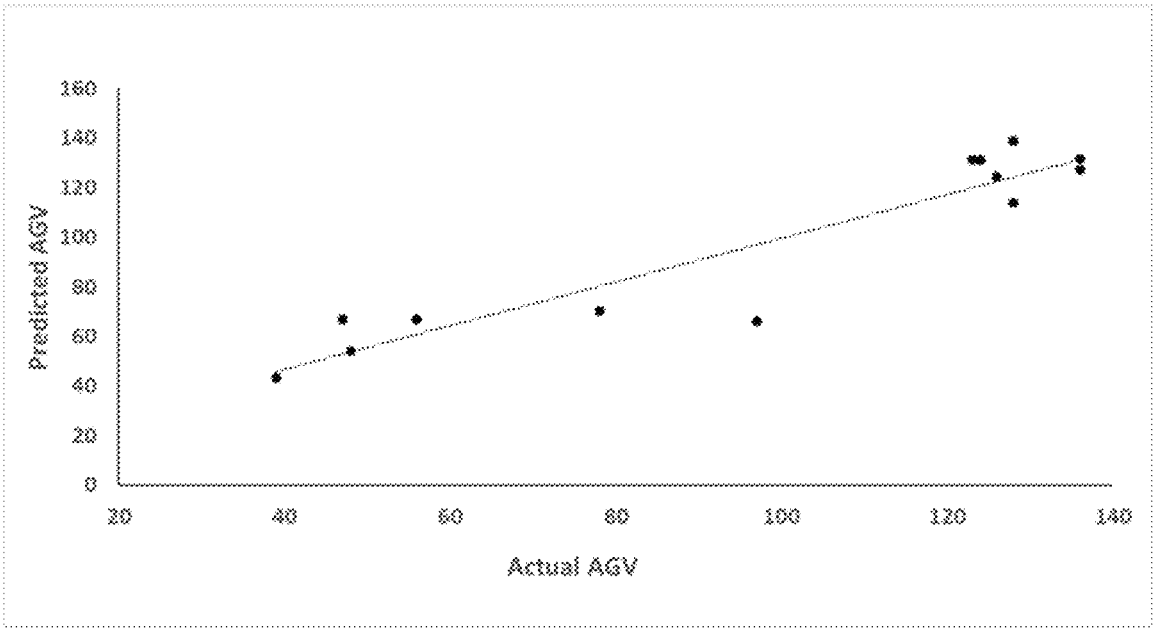
FIG. 2 is a graph of predicted ball rust performance to actual ball rust performance in the context of zinc and total SASH.

In yet other embodiments, the lubricant ball rust performance (ASTM D6557) may also be related to the lubricant zinc content and the lubricant total SASH contribution (ASTM D874) as generally shown in FIG. 2 and/or the relationship of equation 1 below. For instance, ball rust AGV of ASTM D6557 can be determined from lubricant zinc content in ppm and total SASH contribution in weight percent using the relationship of equation (1):

$$AGV=(SASH*196.0269)+(Zinc*-0.01975)-4.17252 \quad \text{(equation 1)}$$

FIG. 2 shows the correlation of the AGV determined from equation (1) relative to the actual AGV measured via ASTM D6557 for a number of representative samples.

Lubricating Oil Compositions

The additives herein are combined with a major amount of a base oil or base oil blend of lubricating viscosity (as described below) in combination with one or more further optional additives to produce a lubricating oil composition. In approaches, the lubricating oil compositions includes about 50 weight percent or more of the base oil blend, about 60 weight percent or more, about 70 weight percent or more, or about 80 weight percent or more to about 95 weight percent or less, about 90 weight percent or less, about 85 weight percent or less of the base oil blend as such blend is further discussed below. The lubricating compositions herein may have a KV100 of about 2 to about 15 cSt (ASTM D445), and preferably, about 5 to about 12 cSt, and more preferably 6 to about 10 cSt.

Base Oil Blend: The base oil used in the lubricating oil compositions herein may be oils of lubricating viscosity and selected from any of the base oils in Groups I-V as specified in the American Petroleum Institute (API) Base Oil Interchangeability Guidelines. The five base oil groups are as follows:

TABLE 1

| Base oil Category | Sulfur (%) | | Saturates (%) | Viscosity Index |
|---|---|---|---|---|
| Group I | >0.03 | and/or | <90 | 80 to 120 |
| Group II | ≤0.03 | and | ≥90 | 80 to 120 |
| Group III | ≤0.03 | and | ≥90 | ≥120 |
| Group IV | All polyalphaolefins (PAOs) | | | |
| Group V | All others not included in Groups I, II, III, or IV | | | |

Groups I, II, and III are mineral oil process stocks. Group IV base oils contain true synthetic molecular species, which are produced by polymerization of olefinically unsaturated hydrocarbons. Many Group V base oils are also true synthetic products and may include diesters, polyol esters, polyalkylene glycols, alkylated aromatics, polyphosphate esters, polyvinyl ethers, and/or polyphenyl ethers, and the like, but may also be naturally occurring oils, such as vegetable oils. It should be noted that although Group III base oils are derived from mineral oil, the rigorous processing that these fluids undergo causes their physical properties to be very similar to some true synthetics, such as PAOs. Therefore, oils derived from Group III base oils may be referred to as synthetic fluids in the industry. Group II+ may comprise high viscosity index Group II.

The base oil blend used in the disclosed lubricating oil composition may be a mineral oil, animal oil, vegetable oil, synthetic oil, synthetic oil blends, or mixtures thereof. Suitable oils may be derived from hydrocracking, hydrogenation, hydrofinishing, unrefined, refined, and re-refined oils, and mixtures thereof.

Unrefined oils are those derived from a natural, mineral, or synthetic source without or with little further purification treatment. Refined oils are similar to the unrefined oils except that they have been treated in one or more purification steps, which may result in the improvement of one or more properties. Examples of suitable purification techniques are solvent extraction, secondary distillation, acid or base extraction, filtration, percolation, and the like. Oils refined to the quality of an edible may or may not be useful. Edible oils may also be called white oils. In some embodiments, lubricating oil compositions are free of edible or white oils.

Re-refined oils are also known as reclaimed or reprocessed oils. These oils are obtained similarly to refined oils using the same or similar processes. Often these oils are additionally processed by techniques directed to removal of spent additives and oil breakdown products.

Mineral oils may include oils obtained by drilling or from plants and animals or any mixtures thereof. For example, such oils may include, but are not limited to, castor oil, lard oil, olive oil, peanut oil, corn oil, soybean oil, and linseed oil, as well as mineral lubricating oils, such as liquid petroleum oils and solvent-treated or acid-treated mineral lubricating oils of the paraffinic, naphthenic or mixed paraffinic-naphthenic types. Such oils may be partially or fully hydrogenated, if desired. Oils derived from coal or shale may also be useful.

Useful synthetic lubricating oils may include hydrocarbon oils such as polymerized, oligomerized, or interpolymerized olefins (e.g., polybutylenes, polypropylenes, propylene-isobutylene copolymers); poly(1-hexenes), poly(1-octenes), trimers or oligomers of 1-decene, e.g., poly(1-decenes), such materials being often referred to as α-olefins, and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof. Polyalphaolefins are typically hydrogenated materials.

Other synthetic lubricating oils include polyol esters, diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

The major amount of base oil included in a lubricating composition may be selected from the group consisting of Group I, Group II, a Group III, a Group IV, a Group V, and a combination of two or more of the foregoing, and wherein the major amount of base oil is other than base oils that arise from provision of additive components or viscosity index improvers in the composition. In another embodiment, the major amount of base oil included in a lubricating composition may be selected from the group consisting of Group II, a Group III, a Group IV, a Group V, and a combination of two or more of the foregoing, and wherein the major amount of base oil is other than base oils that arise from provision of additive components or viscosity index improvers in the composition.

The amount of the oil of lubricating viscosity present may be the balance remaining after subtracting from 100 wt % the sum of the amount of the performance additives inclusive of viscosity index improver(s) and/or pour point depressant(s) and/or other top treat additives. For example, the oil of lubricating viscosity that may be present in a finished fluid may be a major amount, such as greater than about 50 wt %, greater than about 60 wt %, greater than about 70 wt %, greater than about 80 wt %, greater than about 85 wt %, or greater than about 90 wt %.

Optional Additives:

The lubricating oil compositions herein may also include a number of optional additives. Those optional additives are described in the following paragraphs.

Boron-Containing Compounds: In some approaches, the lubricating oil compositions herein may optionally contain one or more boron-containing compounds. Examples of boron-containing compounds include borate esters, borated fatty amines, borated epoxides, borated detergents, and borated dispersants, such as borated succinimide dispersants, as disclosed in U.S. Pat. No. 5,883,057. The boron-containing compound, if present, can be used in an amount sufficient to provide up to about 8 wt %, about 0.01 wt % to about 7 wt %, about 0.05 wt % to about 5 wt %, or about 0.1 wt % to about 3 wt % of the lubricating oil composition.

Extreme Pressure Agents: The lubricating compositions herein may optionally contain one or more extreme pressure agents. Extreme Pressure (EP) agents that are soluble in the oil include sulfur- and chlorosulfur-containing EP agents, chlorinated hydrocarbon EP agents and phosphorus EP agents. Examples of such EP agents include chlorinated wax; organic sulfides and polysulfides such as dibenzyldisulfide, bis(chlorobenzyl) disulfide, dibutyl tetrasulfide, sulfurized methyl ester of oleic acid, sulfurized alkyl phenol, sulfurized dipentene, sulfurized terpene, and sulfurized Diels-Alder adducts; phosphosulfurized hydrocarbons such as the reaction product of phosphorus sulfide with turpentine or methyl oleate; phosphorus esters such as the dihydrocarbyl and trihydrocarbyl phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenyl phosphite; metal thiocarbamates such as zinc dioctyldithiocarbamate and barium heptylphenol diacid; amine salts of alkyl and dialkylphosphoric acids, including, for example, the amine salt of the reaction product of a dialkyldithiophosphoric acid with propylene oxide; and mixtures thereof.

Friction Modifiers: The lubricating compositions herein may optionally contain one or more friction modifiers. Suitable friction modifiers may comprise metal containing and metal-free friction modifiers and may include, but are not limited to, imidazolines, amides, amines, succinimides, alkoxylated amines, alkoxylated ether amines, amine oxides, amidoamines, nitriles, betaines, quaternary amines, imines, amine salts, amino guanadine, alkanolamides, phosphonates, metal-containing compounds, glycerol esters, sulfurized fatty compounds and olefins, sunflower oil other naturally occurring plant or animal oils, dicarboxylic acid esters, esters or partial esters of a polyol and one or more aliphatic or aromatic carboxylic acids, and the like.

Suitable friction modifiers may contain hydrocarbyl groups that are selected from straight chain, branched chain, or aromatic hydrocarbyl groups or mixtures thereof, and may be saturated or unsaturated. The hydrocarbyl groups may be composed of carbon and hydrogen or hetero atoms such as sulfur or oxygen. The hydrocarbyl groups may range from about 12 to about 25 carbon atoms. In some embodiments the friction modifier may be a long chain fatty acid ester. In another embodiment the long chain fatty acid ester may be a mono-ester, or a diester, or a (tri)glyceride. The friction modifier may be a long chain fatty amide, a long chain fatty ester, a long chain fatty epoxide derivatives, or a long chain imidazoline.

Other suitable friction modifiers may include organic, ashless (metal-free), nitrogen-free organic friction modifiers. Such friction modifiers may include esters formed by reacting carboxylic acids and anhydrides with alkanols and generally include a polar terminal group (e.g. carboxyl or hydroxyl) covalently bonded to an oleophilic hydrocarbon chain. An example of an organic ashless nitrogen-free friction modifier is known generally as glycerol monooleate (GMO) which may contain mono-, di-, and tri-esters of oleic acid. Other suitable friction modifiers are described in U.S. Pat. No. 6,723,685, herein incorporated by reference in its entirety.

Aminic friction modifiers may include amines or polyamines. Such compounds can have hydrocarbyl groups that are linear, either saturated or unsaturated, or a mixture thereof and may contain from about 12 to about 25 carbon atoms. Further examples of suitable friction modifiers include alkoxylated amines and alkoxylated ether amines. Such compounds may have hydrocarbyl groups that are linear, either saturated, unsaturated, or a mixture thereof. They may contain from about 12 to about 25 carbon atoms. Examples include ethoxylated amines and ethoxylated ether amines.

The amines and amides may be used as such or in the form of an adduct or reaction product with a boron compound such as a boric oxide, boron halide, metaborate, boric acid or a mono-, di- or tri-alkyl borate. Other suitable friction modifiers are described in U.S. Pat. No. 6,300,291, herein incorporated by reference in its entirety.

A friction modifier may optionally be present in ranges such as about 0 wt % to about 10 wt %, or about 0.01 wt % to about 8 wt %, or about 0.1 wt % to about 4 wt %.

Transition Metal-containing compounds: In another embodiment and subject to the discussion above on total metal contents, the lubricants herein may optionally include a transition metal containing compound or a metalloid. The transition metals may include, but are not limited to, titanium, vanadium, copper, zinc, zirconium, molybdenum, tantalum, tungsten, and the like. Suitable metalloids include, but are not limited to, boron, silicon, antimony, tellurium, and the like.

Viscosity Index Improvers: The lubricating oil compositions herein may optionally contain one or more viscosity index improvers, such as a dispersant olefin copolymer viscosity index improper. Suitable viscosity index improvers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity index improvers may include star polymers and suitable examples are described in US Publication No. 20120101017A1.

The lubricating oil compositions herein may optionally contain one or more dispersant viscosity index improvers in addition to a viscosity index improver or in lieu of a viscosity index improver. Suitable viscosity index improvers may include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine.

In one approach, a suitable dispersant olefin copolymer viscosity index improver includes the reaction product of an acylated olefin copolymer and a polyamine, wherein the acylated olefin copolymer includes an olefin copolymer having grafted thereon about 0.3 to about 0.75 carboxylic groups per 1000 number average molecular weight units of the olefin copolymer, and wherein the olefin copolymer has a number average molecular weight of about 40,000 to about 150,000, and wherein the polyamine is a N-arylphenylene diamine. In optional approaches, the lubricating compositions includes about 1 weight percent to about 4 weight percent of the dispersant olefin copolymer viscosity index improver.

Other Optional Additives: Other additives may be selected to perform one or more functions required of a lubricating fluid. Further, one or more of the mentioned additives may be multi-functional and provide functions in addition to or other than the function prescribed herein. The other performance additives may be in addition to specified additives of the present disclosure and/or may comprise one or more of metal deactivators, viscosity index improvers, ashless TBN boosters, friction modifiers, antiwear agents, corrosion inhibitors, rust inhibitors, dispersants, dispersant viscosity index improvers, extreme pressure agents, antioxidants, foam inhibitors, demulsifiers, emulsifiers, pour point depressants, seal swelling agents and mixtures thereof. Typically, fully-formulated lubricating oil will contain one or more of these performance additives subject to the above discussions on components, amounts, and relationships of various compositions ingredients.

Suitable metal deactivators may include derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides.

Suitable foam inhibitors include silicon-based compounds, such as siloxane.

Suitable pour point depressants may include a polymethylmethacrylates or mixtures thereof. Pour point depressants may be present in an amount sufficient to provide from about 0 wt % to about 1 wt %, about 0.01 wt % to about 0.5 wt %, or about 0.02 wt % to about 0.04 wt % based upon the final weight of the lubricating oil composition.

Suitable additional rust inhibitors may be a single compound or a mixture of compounds having the property of inhibiting corrosion of ferrous metal surfaces. Additional rust inhibitors may be provided so long as they do not conflict with the selected corrosion inhibitors discussed above. Non-limiting examples of rust inhibitors, in addition to those described above, include oil-soluble high molecular weight organic acids, such as 2-ethylhexanoic acid, lauric acid, myristic acid, palmitic acid, oleic acid, linoleic acid, linolenic acid, behenic acid, and cerotic acid, as well as oil-soluble polycarboxylic acids including dimer and trimer acids, such as those produced from tall oil fatty acids, oleic acid, and linoleic acid. Other suitable corrosion inhibitors include long-chain alpha, omega-dicarboxylic acids in the molecular weight range of about 600 to about 3000 and alkenylsuccinic acids in which the alkenyl group contains about 10 or more carbon atoms such as, tetrapropenylsuccinic acid, tetradecenylsuccinic acid, and hexadecenylsuccinic acid. Another useful type of acidic corrosion inhibitors are the half esters of alkenyl succinic acids having about 8 to about 24 carbon atoms in the alkenyl group with alcohols such as the polyglycols. The corresponding half amides of such alkenyl succinic acids are also useful. A useful rust inhibitor is a high molecular weight organic acid.

The rust inhibitor, if present, can be used in an amount sufficient to provide about 0 wt % to about 5 wt %, about 0.01 wt % to about 3 wt %, about 0.1 wt % to about 2 wt %, based upon the final weight of the lubricating oil composition.

In general terms, a suitable lubricant herein may include additive components in the ranges listed in the following table.

TABLE 2

Suitable Low-Ash Lubricating Compositions

| Component | Wt. % (Suitable Embodiments) | Wt. % (Suitable Embodiments) |
|---|---|---|
| Succinimide Dispersant(s) | 5.0-10.0 | 5.0-8.0 |
| Antioxidant(s) | 0.3-4.0 | 0.5-3.0 |
| Detergent(s) | 0.1-5.0 | 0.5-3.0 |
| Antiwear (ashless) | 0.3-1.0 | 0.3-0.5 |
| Ashless TBN booster(s) | 0.0-1.0 | 0.01-0.5 |
| Corrosion inhibitor(s) | 0.0-5.0 | 0.0-2.0 |
| Ashless Antiwear | 0.0-1.0 | 0-0.8 |
| Metal-containing Antiwear | 0-1.0 | 0.-0.5 |
| Antifoaming agent(s) | 0.0-5.0 | 0.001-0.15 |
| Pour point depressant(s) | 0.0-5.0 | 0.01-1.5 |
| Viscosity index improver(s) | 0.0-25.0 | 0.1-15.0 |
| Dispersant viscosity index improver(s) | 0.0-10.0 | 0.0- 5.0 |
| Friction modifier(s) | 0.0-5.0 | 0.01-2.0 |
| Base oil | Balance | Balance |
| Total | 100 | 100 |

The percentages of each component above represent the weight percent of each component, based upon the weight of the final lubricating oil composition. The remainder of the lubricating oil composition consists of one or more base oils. Additives used in formulating the compositions described herein may be blended into the base oil individually or in various sub-combinations. However, it may be suitable to blend all of the components concurrently using an additive concentrate (i.e., additives plus a diluent, such as a hydrocarbon solvent). Fully formulated lubricants conventionally contain an additive package, referred to herein as a dispersant/inhibitor package or DI package, that will supply the characteristics that are required in the formulation.

Lubricants herein are configured for use in various types of lubricants, such as automotive lubricants and/or greases, internal combustion engine oils, hybrid engine oils, electric engine lubricants, drivetrain lubricants, transmission lubricants, gear oils, hydraulic lubricants, tractor hydraulic fluids, metal working fluids, turbine engine lubricants, stationary engine lubricants, tractor lubricants, motorcycle lubricants, power steering fluids, clutch fluids, axles fluids, wet break fluids, and the like. Suitable engine types may include, but are not limited to heavy-duty diesel, passenger car, light duty diesel, medium speed diesel, or marine engines. An internal combustion engine may be a diesel fueled engine, a gasoline fueled engine, a natural gas fueled engine, a bio-fueled engine, a mixed diesel/biofuel fueled engine, a mixed gasoline/biofuel fueled engine, an alcohol fueled engine, a mixed gasoline/alcohol fueled engine, a compressed natural gas (CNG) fueled engine, or mixtures thereof. A diesel engine may be a compression-ignited engine. A gasoline engine may be a spark-ignited engine. An internal combustion engine may also be used in combination with an electrical or battery source of power. An engine so configured is commonly known as a hybrid engine. The internal combustion engine may be a 2-stroke, 4-stroke, or rotary engine. Suitable internal combustion engines include marine diesel engines (such as inland marine), aviation piston engines, low-load diesel engines, and motorcycle, automobile, locomotive, and truck engines. Engines may be coupled with a turbocharger.

The terms "oil composition," "lubrication composition," "lubricating oil composition," "lubricating oil," "lubricant composition," "lubricating composition," "fully formulated lubricant composition," "lubricant," "crankcase oil," "crankcase lubricant," "engine oil," "engine lubricant," "motor oil," and "motor lubricant" are considered synonymous, fully interchangeable terminology referring to the finished lubrication product comprising a major amount of a base oil plus a minor amount of an additive composition.

As used herein, the terms "additive package," "additive concentrate," "additive composition," "engine oil additive package," "engine oil additive concentrate," "crankcase additive package," "crankcase additive concentrate," "motor oil additive package," "motor oil concentrate," are considered synonymous, fully interchangeable terminology referring the portion of the lubricating oil composition excluding the major amount of base oil stock mixture. The additive package may or may not include the viscosity index improver or pour point depressant.

The term "overbased" relates to metal salts, such as metal salts of sulfonates, carboxylates, salicylates, and/or phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the metal ratio is one and in an overbased salt, MR, is greater than one. They are commonly referred to as overbased, hyperbased, or superbased salts and may be salts of organic sulfur acids, carboxylic acids, salicylates, sulfonates, and/or phenols.

The term "alkaline earth metal" relates to calcium, barium, magnesium, and strontium, and the term "alkali metal" refers to lithium, sodium, potassium, rubidium, and cesium.

As used herein, the term "hydrocarbyl" or "hydrocarbyl substituent" or "hydrocarbyl group" is used in its ordinary sense, which is well-known to those skilled in the art. Specifically, it refers to a group having a carbon atom directly attached to the remainder of the molecule and having a predominantly hydrocarbon character. Each hydrocarbyl group is independently selected from hydrocarbon substituents, and substituted hydrocarbon substituents containing one or more of halo groups, hydroxyl groups, alkoxy groups, mercapto groups, nitro groups, nitroso groups, amino groups, pyridyl groups, furyl groups, imidazolyl groups, oxygen and nitrogen, and wherein no more than two non-hydrocarbon substituents are present for every ten carbon atoms in the hydrocarbyl group.

As used herein, the term "hydrocarbylene substituent" or "hydrocarbylene group" is used in its ordinary sense, which is well-known to those skilled in the art. Specifically, it refers to a group that is directly attached at two locations of the molecule to the remainder of the molecule by a carbon atom and having predominantly hydrocarbon character. Each hydrocarbylene group is independently selected from divalent hydrocarbon substituents, and substituted divalent hydrocarbon substituents containing halo groups, alkyl groups, aryl groups, alkylaryl groups, arylalkyl groups, hydroxyl groups, alkoxy groups, mercapto groups, nitro groups, nitroso groups, amino groups, pyridyl groups, furyl groups, imidazolyl groups, oxygen and nitrogen, and wherein no more than two non-hydrocarbon substituents is present for every ten carbon atoms in the hydrocarbylene group.

As used herein, the term "percent by weight", unless expressly stated otherwise, means the percentage the recited component represents to the weight of the entire composition.

As used herein, the term "ppm" or "ppmw," unless expressly stated otherwise, refers to parts per million based on weight.

The terms "soluble," "oil-soluble," or "dispersible" used herein may, but does not necessarily, indicate that the compounds or additives are soluble, dissolvable, miscible, or capable of being suspended in the oil in all proportions. The foregoing terms do mean, however, that they are, for instance, soluble, suspendable, dissolvable, or stably dispersible in oil to an extent sufficient to exert their intended effect in the environment in which the oil is employed. Moreover, the additional incorporation of other additives may also permit incorporation of higher levels of a particular additive, if desired.

The term "TBN" as employed herein is used to denote the Total Base Number in mg KOH/g as measured by either ASTM D2896 or ASTM D4739 as specified herein.

The term "alkyl" as employed herein refers to straight, branched, cyclic, and/or substituted saturated chain moieties of from about 1 to about 100 carbon atoms. The term "alkenyl" as employed herein refers to straight, branched, cyclic, and/or substituted unsaturated chain moieties of from about 3 to about 10 carbon atoms. The term "aryl" as employed herein refers to single and multi-ring aromatic compounds that may include alkyl, alkenyl, alkylaryl, amino, hydroxyl, alkoxy, halo substituents, and/or heteroatoms including, but not limited to, nitrogen, oxygen, and sulfur.

The molecular weight for any embodiment herein may be determined with a gel permeation chromatography (GPC) instrument obtained from Waters or the like instrument and the data processed with Waters Empower Software or the like software. The GPC instrument may be equipped with a Waters Separations Module and Waters Refractive Index detector (or the like optional equipment). The GPC operating conditions may include a guard column, 4 Agilent PLgel columns (length of 300×7.5 mm; particle size of 5μ, and pore size ranging from 100-10000 Å) with the column temperature at about 40° C. Un-stabilized HPLC grade tetrahydrofuran (THF) may be used as solvent, at a flow rate of 1.0 mL/min. The GPC instrument may be calibrated with commercially available polystyrene (PS) standards having a narrow molecular weight distribution ranging from 500-380,000 g/mol. The calibration curve can be extrapolated for samples having a mass less than 500 g/mol. Samples and PS standards can be in dissolved in THF and prepared at concentration of 0.1 to 0.5 wt. % and used without filtration. GPC measurements are also described in U.S. Pat. No. 5,266,223, which is incorporated herein by reference. The GPC method additionally provides molecular weight distribution information; see, for example, W. W. Yau, J. J. Kirkland and D. D. Bly, "Modern Size Exclusion Liquid Chromatography", John Wiley and Sons, New York, 1979, incorporated herein by reference.

As used herein, "sulfated ash" or "SASH" refers to the amount of sulfated ash as measured using ASTM D874. Alternatively, sulfated ash may also be calculated based on the amount of metals in the lubricant. For example, sulfated ash (SASH) may optionally be calculated based on the total metallic elements that contribute to SASH in the lubricant composition adjusted by factors for each metallic type. The metals that contribute to SASH include (along with the adjustment factor) barium (1.7), boron (3.22), calcium (3.4), copper (1.252), lead (1.464), lithium (7.92), magnesium (4.95), manganese (1.291), molybdenum (1.5), potassium (2.33), sodium (3.09), and zinc (1.5). Specifically, the ppmw content of each of the metallic elements present in a lubricating oil composition that is considered to contribute to sulfated ash is multiplied by its corresponding factor above; then, the product for each metallic element/factor adjustment is summed and the total is divided by 10,000 to calculate the weight percent of SASH in the lubricating compositions. Unless specified otherwise, all sulfated ash levels herein are measured using ASTM D874. See also, Nadkarni, R., Ledesma, R., and Via G., "Sulfated Ash Test Method: Limitations of Reliability and Reproducibility," SAE Technical Paper 952548, 1995 or Takatoshi Kunihiro, "Method of Estimating Sulfated Ash in Engine Oils by Metal Element Analyses," Journal of the Japan Petroleum Institute, 1992, volume 35, issue 6, pages 460-465, which are both reproduced herein.

EXAMPLES

A better understanding of the present disclosure and its many advantages may be clarified with the following example. The following examples are illustrative and not limiting thereof in either scope or spirit. Those skilled in the art will readily understand that variations of the components, methods, steps, and devices described in these examples can be used. Unless noted otherwise or apparent from the context of discussion in the Examples below and throughout this disclosure, all percentages, ratios, and parts noted in this disclosure are by weight. Any standardized test method noted in the Examples, disclosure, or claims, unless apparent from the context of its use, refers to the version of the test method publicly available at the time of the filing of the present disclosure.

Example 1

This Example evaluated Inventive passenger car lubricating compositions including varying amounts of (1) a detergent system including an overbased calcium sulfonate having a TBN of about 300 (ASTM D4739) and overbased magnesium sulfonate having a TBN of about 400 (ASTM 4739) and (2) an antiwear system including an ashless phosphorus-containing antiwear compound (e.g., 3-[[bis(2-methylpropoxy) phosphinothioy]thio]-2-methyl-propanoic acid) and optional amounts of a metal-containing antiwear compound (e.g., a zinc dialkyldithiophosphate with 100% of the alkyl groups derived from a primary alcohol). Each composition of this Example also included the same amounts of other additives including antioxidants, dispersants, friction modifiers, antifoam additives, pour point depressants, viscosity modifiers, and balance of base oil to achieve a KV100 as noted in the Tables. Fluid relationships are provided in Table 3 and performance results are provided in Table 4.

TABLE 3

Fluid Relationships—Inventive Compositions

| | | Inv 1 | Inv 2 | Inv 3 | Inv 4 | Inv 5 |
|---|---|---|---|---|---|---|
| KV100° C. (D445) | cSt | 8.5 | 8.2 | 8.8 | 8.6 | 8.7 |
| Ca | ppm | 312 | 611 | 678 | 352 | 645 |
| Mg | ppm | 537 | 1128 | 1132 | 540 | 1206 |
| P | ppm | 309 | 323 | 310 | 643 | 657 |
| Zn | ppm | 0 | 0 | 172 | 0 | 0 |
| Phosphorus Ratio P(Ashless AW):P(Metal AW) | | 100:0 | 100:0 | 50:50 | 100:0 | 100:0 |
| TBN (D2896) | mg KOH/g | 5.7 | 8.8 | 8.7 | 6.1 | 9.3 |
| TBN (D4739) | mg KOH/g | 3.8 | 6.9 | 6.27 | 4.1 | 7.3 |
| TBN Ratio (D4739/D2896)* | | 66.7 | 78.1 | 72.1 | 66.6 | 78.6 |
| Mg/Ca Ratio | | 1.7 | 1.8 | 1.7 | 1.5 | 1.9 |

TABLE 3-continued

| Fluid Relationships—Inventive Compositions | | | | | | |
|---|---|---|---|---|---|---|
| | | Inv 1 | Inv 2 | Inv 3 | Inv 4 | Inv 5 |
| Total SASH (D874) | wt % | 0.36 | 0.69 | 0.71 | 0.38 | 0.73 |
| Detergent SASH (Calculated) | wt % | 0.37 | 0.77 | 0.79 | 0.39 | 0.82 |
| Metal-Containing Antiwear SASH (Calculated) | wt % | 0 | 0 | 0.025 | 0 | 0 |
| Zinc/total SASH** | | 0 | 0 | 242 | 0 | 0 |

*TBN ratio, for instance, of Inv1 is calculated as follows: 3.8/5.7*100 = 66.7%

**Zinc/total SASH ratio, for instance, of Inv 3 is calculated as follows: 172 ppm zinc/0.71 wt % total SASH

TABLE 4

| Performance—Inventive Compositions | | | | | | |
|---|---|---|---|---|---|---|
| | | Inv 1 | Inv 2 | Inv 3 | Inv 4 | Inv 5 |
| Sulfated Ash (D874) | % | 0.36 | 0.69 | 0.71 | 0.38 | 0.73 |
| Ball Rust Test (D6557) | AGV** | 97 | 124 | 136 | 78 | 128 |
| HTCBT Metal (D6594)* | ppm | 184 | 229 | 267 | 315 | 198 |
| 25° C. emulsion (D7563) | Oil:Emulsion:Water | 36:61:0 | 20:80:0 | 19:81:0 | 19:81:0 | 17:83:0 |
| 0° C. Emulsion (D7563) | Oil:Emulsion:Water | 9:91:0 | 4:96:0 | 5:95:0 | 5:95:0 | 3:97:0 |

*total ppm of copper, lead, and tin

**According to D6557, rust ball test results are +/−15 AGV (average gray value) when performed in the same laboratory.

Comparative Example 1

This Comparative Example evaluated failing passenger car lubricating compositions including varying amounts of (1) a detergent system including an overbased calcium sulfonate having a TBN of about 300 (ASTM D4739) and overbased magnesium sulfonate having a TBN of about 400 (ASTM D4739) and (2) an antiwear system including only a metal-containing phosphorus compound (e.g., zinc dialkyldithiophosphate with 100% of the alkyl groups derived from a primary alcohol) or mixed anti-wear system as noted in Table 5. Each comparative composition also included the same amounts of other additives including antioxidants, dispersants, friction modifiers, antifoam additives, pour point depressants, viscosity modifiers, and balance of base oil to achieve a KV100 as noted in the Tables. Fluid relationships are provided in Table 5 and results are provided in Table 6.

TABLE 5

| Fluid Relationships—Comparative Compositions | | | | | | | | |
|---|---|---|---|---|---|---|---|---|
| | | Compare 1 | Compare 2 | Compare 3 | Compare 4 | Compare 5 | Compare 6 | Compare 7 |
| KV100° C. (D445) | cSt | 8.7 | 8.7 | 8.6 | 8.7 | 8.7 | 8.6 | 8.6 |
| Ca | ppm | 269 | 566 | 181 | 532 | 752 | 311 | 280 |
| Mg | ppm | 424 | 931 | 305 | 878 | 1140 | 647 | 622 |
| P | ppm | 301 | 304 | 600 | 603 | 659 | 310 | 624 |
| Zn | ppm | 33 | 332 | 669 | 672 | 394 | 181 | 366 |
| Phos Ratio: P(Ashless AW):P(Metal AW) | | 0:100 | 0:100 | 0:100 | 0:100 | 50:50 | 50:50 | 50:50 |
| TBN (D2896) | mg KOH/g | 5.3 | 8.3 | 4.6 | 8.0 | 8.9 | 5.7 | 5.7 |
| TBN (D4739) | mg KOH/g | 3.15 | 5.43 | 2.44 | 6.0 | 6.5 | 3.8 | 3.7 |
| TBN Ratio (D4739/D2896) | | 59.4 | 65.4 | 53.0 | 74.5 | 73.4 | 66.1 | 64.2 |
| Mg/Ca Ratio | | 1.6 | 1.6 | 1.7 | 1.7 | 1.5 | 2.1 | 2.2 |
| Total SASH (D874) | wt % | 0.33 | 0.69 | 0.31 | 0.67 | 0.71 | 0.38 | 0.4 |
| Detergent SASH (Calculated) | wt % | 0.3 | 0.66 | 0.21 | 0.62 | 0.82 | 0.43 | 0.4 |
| Metal Containing AW SASH (Calculated) | wt % | 0.05 | 0.05 | 0.1 | 0.1 | 0.059 | 0.027 | 0.055 |
| Zinc/total SASH | | 1003 | 481 | 2158 | 1002 | 554 | 476 | 915 |

TABLE 6

Performance—Comparative Compositions (Failing is bold and underline)

| | | Compare 1 | Compare 2 | Compare 3 | Compare 4 | Compare 5 | Compare 6 | Compare 7 |
|---|---|---|---|---|---|---|---|---|
| Total Sulfated Ash (D874) | % | 0.33 | 0.69 | 0.31 | 0.67 | 0.71 | 0.38 | 0.4 |
| Zinc/total SASH | | 1003 | 481 | 2158 | 1002 | 554 | 476 | 915 |
| Ball Rust Test (D6557) | AGV** | **48** | 126 | **39** | 128 | 136 | **56** | **47** |
| HTCBT Metal (D6594)* | ppm | **397** | **432** | 238 | 264 | 295 | 279 | 327 |
| 25° C. emulsion (D7563) | Oil:Emulsion:Water | 33:67:0 | 19:81:0 | **86:0:14** | **86:0:14** | **85:0:15** | 23:77:0 | 27:75:0 |
| 0° C. Emulsion (D7563) | Oil:Emulsion:Water | 4:96:0 | 2:98:0 | 6:94:0 | 84:0:6 | 6:94:0 | 5:95:0 | 5:95:0 |

*total ppm of copper, lead, and tin

**According to ASTM D6557, results are +/−15 AGV when performed in the same laboratory.

Example 3

This Example includes a predictive equation to determine ball rust performance (ASTM D6557). For instance, ball rust AGV of ASTM D6557 can be determined from lubricant zinc content in ppm and total SASH contribution in weight percent using the relationship of equation (1):

$$AGV=(SASH*196.0269)+(Zinc*-0.01975)-4.17252 \quad \text{(equation 1).}$$

Table 7 below and FIG. 2 shows the correlation of the AGV determined from equation (1) relative to the actual AGV measured via ASTM D6557 for a number of representative samples consistent with those described in Example 1 and Comparative Example 1.

TABLE 7

| Sample | ppm Zn | Wt % SASH | Actual AGV Response | Equation AGV Predicted |
|---|---|---|---|---|
| 1 | 2 | 0.36 | 97 | 66 |
| 2 | 181 | 0.38 | 56 | 67 |
| 3 | 331 | 0.33 | 48 | 54 |
| 4 | 0 | 0.69 | 124 | 131 |
| 5 | 172 | 0.71 | 136 | 132 |
| 6 | 332 | 0.69 | 126 | 125 |
| 7 | 1 | 0.38 | 78 | 70 |
| 8 | 366 | 0.4 | 47 | 67 |
| 9 | 669 | 0.31 | 39 | 43 |
| 10 | 3 | 0.73 | 128 | 139 |
| 11 | 394 | 0.71 | 136 | 127 |
| 12 | 672 | 0.67 | 128 | 114 |
| 13 | 4 | 0.69 | 123 | 131 |

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is to be understood that each component, compound, substituent or parameter disclosed herein is to be interpreted as being disclosed for use alone or in combination with one or more of each and every other component, compound, substituent or parameter disclosed herein.

It is further understood that each range disclosed herein is to be interpreted as a disclosure of each specific value within the disclosed range that has the same number of significant digits. Thus, for example, a range from 1 to 4 is to be interpreted as an express disclosure of the values 1, 2, 3 and 4 as well as any range of such values.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range. That is, it is also further understood that any range between the endpoint values within the broad range is also discussed herein. Thus, a range from 1 to 4 also means a range from 1 to 3, 1 to 2, 2 to 4, 2 to 3, and so forth.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A passenger car lubricating composition having a low sulfated ash content, the passenger car lubricating composition comprising:

one or more base oils of lubricating viscosity;

an antiwear system including one or more ashless phosphorus-containing antiwear compounds and, optionally, one or more metal-containing antiwear compounds, and wherein a phosphorus weight ratio of phosphorus from the one or more ashless antiwear compounds to phosphorus from the one or more optional metal-containing antiwear compounds is about 50:50 to about 100:0, wherein the ashless phosphorus-containing antiwear additive is a triester of a dithiophosphate having two oxygen ester moieties and a sulfur ester moiety, wherein the ashless phosphorus-containing antiwear additive has a molecular weight of at least about 490 g/mol, and wherein each oxygen ester is derived from 4-methyl-2-pentyl alcohol and the sulfur ester is derived from dibutyl maleate;

a sulfated ash content of about 0.75 weight percent or less as measured pursuant to ASTM D874;

about 700 ppm or less of total phosphorus contributed by the one or more ashless phosphorus-containing antiwear compounds and the optional one or more metal-containing antiwear compounds;

a detergent system having a weight ratio of magnesium-to-calcium of about 2.0 or less; and a TBN ratio of TBN measured per ASTM D4739 relative to TBN measured per ASTM D2896 of at least about 60 percent.

2. The passenger car lubricating composition of claim 1, wherein the TBN ratio is about 60 percent to 70 percent when the sulfated ash is less than 0.5 weight percent, and/or wherein the TBN ratio is greater than 70 to about 80 percent when the sulfated ash is greater than 0.5 weight percent.

3. The passenger car lubricating composition of claim 1, wherein a ratio of zinc in ppm to weight percent total SASH (ASTM D874) is less than about 400 when the total SASH is less than about 0.5 weight percent.

4. The passenger car lubricating composition of claim 1, wherein the ashless phosphorus-containing antiwear additive is a dialkyl dithiophosphate ester, a triester of a dithiophosphate, an amyl acid phosphate, a diamyl acid phosphate, a dibutyl hydrogen phosphonate, a dimethyl octadecyl phosphonate, salts thereof, or mixtures thereof.

5. The passenger car lubricating composition of claim 1, wherein the one or more ashless phosphorus-containing antiwear additive is a dialkyl dithiophosphate antiwear additive having a structure of Formula I, or a salt thereof:

(Formula I)

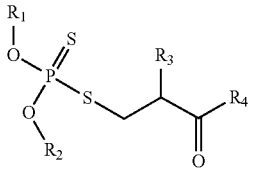

wherein $R_1$ and $R_2$ are, independently, a C3 to C8 linear or branched alkyl group, $R_3$ is hydrogen or methyl, and $R_4$ is a hydroxy group or a hydrocarbyl group.

6. The passenger car lubricating composition of claim 1, wherein the molecular weight of the ashless phosphorus-containing antiwear additive is up to about 650 g/mol.

7. The passenger car lubricating composition of claim 1, wherein the metal-containing antiwear additive is one or more zinc dihydrocarbyl dithiophosphate compounds.

8. The passenger car lubricating composition of claim 7, wherein the zinc dihydrocarbyl dithiophosphate compound is derived from at least about 60 weight percent secondary alcohols.

9. The passenger car lubricating composition of claim 7, wherein the one or more zinc dihydrocarbyl dithiophosphate compounds have a structure of Formula III:

(Formula III)

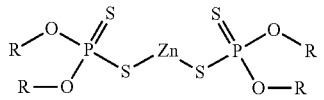

wherein each R group of Formula III is, independently, a linear or branched C3 to C16 hydrocarbyl group.

10. The passenger car lubricating composition of claim 9, wherein each R group is, independently, a linear or branched C4 to C8 hydrocarbyl group.

11. The passenger car lubricating composition of claim 7, wherein the hydrocarbyl groups of the one or more zinc dihydrocarbyl dithiophosphate compounds are selected from one or more of ethylhexyl groups, butyl groups, methyl isobutyl groups, pentyl groups, methyl pentyl groups, isopentyl groups, isobutyl groups, propyl groups, isopropyl groups, or combinations thereof.

12. The passenger car lubricating composition of claim 1, wherein the ashless phosphorus-containing antiwear compounds and the optional metal-containing antiwear compounds contribute a total of about 350 ppm or less phosphorus.

13. The passenger car lubricating composition of claim 1, wherein the passenger car lubricating composition exhibits a rust rating of 70 AGV or greater in the Ball Rust Test of ASTM D6557.

14. The passenger car lubricating composition of claim 13, wherein the passenger car lubricating composition has about 330 ppm or less of total copper, lead, and tin combined pursuant to the high temperature corrosion bench test (HTCBT) of ASTM D6594.

15. The passenger car lubricating composition of claim 14, wherein the passenger car lubricating composition exhibits emulsion stability with 0 percent water separation at 0° C. and/or 25° C. pursuant to ASTM D7563.

16. The passenger car lubricating composition of claim 1, wherein the detergent system includes an overbased calcium sulfonate detergent and an overbased magnesium sulfonate detergent contributing about 200 to about 1000 ppm calcium and about 500 to about 1500 ppm magnesium to the passenger car lubricating composition.

17. The passenger car lubricating composition of claim 1, wherein the detergent system has a weight ratio of magnesium to calcium of at least about 1.0.

* * * * *